US005460231A

United States Patent [19]

Collins

[11] Patent Number: 5,460,231

[45] Date of Patent: Oct. 24, 1995

[54] DEVICE AND METHOD FOR AUGERING A CONICAL HOLE IN SOLID MEDIA

[76] Inventor: James S. Collins, 320 Muskingham Dr., Marietta, Ohio 45750

[21] Appl. No.: 292,849

[22] Filed: Aug. 19, 1994

[51] Int. Cl.[6] ..... E21B 10/64

[52] U.S. Cl. ..... 175/258; 175/272; 175/273; 175/385; 52/155

[58] Field of Search ..... 52/155, 160, 742; 405/231, 232, 244; 175/385, 386, 258, 260, 266, 269, 272, 273

[56] References Cited

U.S. PATENT DOCUMENTS

| | | | |
|---|---|---|---|
| 165,787 | 7/1875 | Bullock | 175/272 |
| 793,289 | 6/1905 | Futhey . | |
| 1,406,348 | 2/1922 | Corrigan | 175/272 |
| 1,548,541 | 8/1925 | McClease . | |
| 1,617,043 | 2/1927 | Carter . | |
| 1,858,926 | 5/1932 | Grau et al. . | |
| 2,225,165 | 12/1940 | Dunlap, Jr. | 255/66 |
| 2,602,642 | 7/1952 | Baker | 175/269 |
| 2,754,089 | 7/1956 | Kammerer, Jr. | 175/269 |
| 2,799,479 | 7/1957 | Kammerer | 255/76 |
| 3,050,142 | 8/1962 | Kammerer, Jr. | 175/260 |
| 3,331,439 | 7/1967 | Sanford | 175/269 |
| 3,661,219 | 5/1972 | Okuyama et al. | 175/260 |
| 4,843,785 | 7/1989 | Sero et al. | 52/160 |
| 4,882,891 | 11/1989 | Sero et al. | 52/742 |
| 4,974,997 | 12/1990 | Sero et al. | 405/231 |
| 5,036,921 | 8/1991 | Pittard et al. | 175/266 X |
| 5,201,817 | 4/1993 | Hailey | 175/269 |
| 5,234,290 | 8/1993 | Collins | 405/249 |

*Primary Examiner*—Ramon S. Britts
*Assistant Examiner*—Frank S. Tsay
*Attorney, Agent, or Firm*—Webb Ziesenheim Bruening, et al.

[57] ABSTRACT

A device for augering a conical hole in a solid medium that includes a first elongated member that extends along a longitudinal axis and a cutting blade having a cutting section and a non-cutting section coupled to the first elongated member. The rod is adapted to be rotated about the longitudinal axis. A motor is coupled to the first elongated member which rotates the cutting blade about the longitudinal axis. A shroud is provided through which the first elongated member passes. The shroud attaches to a hydraulic unit. Activation of the hydraulic unit causes the first elongated member to move in a longitudinal direction, which causes the cutting blade to move in a radial direction thereby forming a conical hole in a solid medium. The device is used for forming holes used in foundations and anchors. Also disclosed is a method of operation of the device to form a conical hole in solid media.

27 Claims, 17 Drawing Sheets

DEVICE AND METHOD FOR AUGERING A CONICAL HOLE IN SOLID MEDIA

BACKGROUND OF THE INVENTION

1. Field of the Invention

The present invention relates to an apparatus for installing a structural anchor or foundation in a hole formed in solid media.

2. Description of the Prior Art

Structural foundations are used to transmit the weight of the structure to an underlying medium, such as soil, rock or other material, that serves as a basic supporting member. Preferably, the foundation must be essentially unyielding, since one of the chief requirements is to minimize or eliminate settlement due to yielding of the medium under applied loads. The foundation operates through compressive forces applied by the static structure through the foundation and into the medium. In many cases, this is nothing more than a concrete column placed within an augered hole in soil. The strength of the foundation is obtained through the bearing surface at the bottom of the hole through a direct bearing load. The Zone of Influence is directly related to the area of the bottom of the hole.

A structural anchor is used to hold an object in place. The anchor is set in a solid medium, such as soil, and holds a structural object, say for example, a tower guy, in place through tensile forces. More specifically, anchors installed in soil typically include a bar or cable attached to an anchor positioned in a cylindrical augered hole. In many cases, the anchor is nothing more than a concrete plug received by the hole. The anchored device, such as the above described guy, is then attached to a cable or bar. Tensile forces exerted against the plug and the soil hold a structure in place when an axial load or tensile force is applied to the bar or cable. The anchor strength is obtained from frictional forces between the sides of the hole and the concrete plug. It is difficult to estimate the strength of the anchor, which is a function of the Zone of Influence of the anchor. It has been found that the Zone of Influence is directly related, in this type of anchor, to the frictional forces.

Anchoring and foundation arrangements are disclosed in U.S. Pat. Nos. 4,882,891; 4,974,997; 4,843,785; and 5,234,290, all of which are incorporated herein by reference. These patents further disclose that soil foundations and soil anchors yield improved results when the soil adjacent the augered hole is compacted. These disclosed arrangements also work well in unstable media which can also be compacted. However, in some cases, the medium cannot be compacted, for example, when the foundation or anchor is set in rock.

With the exception to the anchors and foundations disclosed in the above identified patents, anchors and foundations formed in soil are typically formed within only cylindrical augered holes. The anchors and foundations obtain a substantial amount of their strength through the corresponding Zone of Influence described above. The strength of the anchor or foundation is directly related to the depth and/or diameter of the augered hole. However, in some instances, the hole cannot be augered to the appropriate depth, whereby the anchor or the foundation can fail, resulting in injuries or loss of life, not to mention property damage.

Therefore, it is an object of my invention to provide a device for improving the performance of anchors and foundations.

It is also an object of my invention to install an anchor or a foundation in solid media quickly and inexpensively.

It is yet another object of my invention to enable anchors and foundations to transfer the loading applied thereto directly in a solid medium, i.e., rock, concrete, plastic or metal, to transfer the loading directly into the medium using the medium's strength to the fullest possible extent through bearing or compressive loading.

SUMMARY OF THE INVENTION

My invention is a device for augering a conical hole that includes a first elongated member, a cutting blade and a second elongated member. The first elongated member includes a first and a second end extending along a longitudinal axis. The cutting blade includes a cutting section and a non-cutting section. The second end of the first elongated member is coupled to the cutting blade. The cutting blade is moveable relative to the first elongated member and adapted to be rotated about the longitudinal axis by the first elongated member. The second elongated member extends along the longitudinal axis and includes a first and second end. The second elongated member second end couples to the non-cutting section of the cutting blade. One of the first elongated member and the second elongated member is adapted to move in a longitudinal direction relative to the other of the first elongated member and the second elongated member thereby causing the cutting blade to move in a radial direction while the cutting blade is rotated by the first elongated member.

The second elongated member can be a hollow shaft to which the first elongated member passes. A base can be secured to the second elongated member, wherein the first end of the second elongated member is rotatably attached to the base.

A plug can be provided that is secured to the second end of the first elongated member. The cutting blade is pivotally secured to the second end of the second elongated member wherein the plug coacts with the cutting blade when the first elongated member is moves in the longitudinal direction thereby forcing the blade to move or pivot in the radial direction. The plug includes a surface defining a slot that receives the cutting blade. This surface includes a base portion adapted to contact the non-cutting section of the cutting blade.

A coupler can be provided that slideably receives the first end of the first elongated member, whereby the first elongated member is adapted to move in the longitudinal direction relative to the coupler. The coupler coacts with the first elongated member to rotate the first elongated member about the longitudinal axis when the coupler is rotated about the longitudinal axis. The coupler includes a sleeve having an open end and an inner surface defining a cavity for receiving the first end of the first elongated member. The inner surface can define a rectangularly shaped cavity.

A motor is coupled to the first end of the first elongated member for rotating the first elongated member about the first longitudinal axis.

A device for moving the first elongated member in the longitudinal direction can be provided. This device includes a hydraulic cylinder unit having a piston arm moveable within a cylinder. A portion of the piston arm extends out of the cylinder and is adapted to extend and retract into the cylinder. A first bearing plate is secured to the cylinder and a second bearing plate is secured to the piston arm, wherein the bearing plates are parallel to each other. A nipple is secured to the cylinder for charging hydraulic fluid thereto. Entry of the fluid into the cylinder causes the piston arm to extend outwardly from the cylinder. A first bearing plate hole is defined in the first bearing plate and a second bearing plate hole is defined in the second bearing plate. The first and second holes are coaxially aligned with each other for the passage of the first elongated member therethrough. The hydraulic cylinder unit is adapted so that a change in hydraulic fluid pressure in the cylinder changes the distance between the bearing plates. A restraining member is secured to the first elongated member. A first thrust bearing is coupled to restraining member and the first bearing plate. A second thrust bearing is coupled to the second elongated member and the second bearing plate. Rotating the first elongated member about the longitudinal axis will not rotate the device for moving the first elongated member in a longitudinal direction.

Another embodiment of the device to move the elongated member in the longitudinal direction can include a bearing plate having an opening disposed therein, wherein the first elongated member passes through the opening and the second elongated member is secured to the bearing plate. A hollow threaded collar is provided that attaches to the second bearing plate. The first elongated member passes through the collar. A threaded member threadedly engages to the collar. A restraining member attaches to the first elongated member. A first thrust bearing couples to the restraining member and the threaded member and a second thrust bearing couples to the bearing plate and the second elongated member. Rotating in the first elongated member about the longitudinal axis will not rotate the bearing plate, the collar and the threaded member, and rotation of the threaded member about the longitudinal axis forces the first elongated member to move in the longitudinal direction by said restraining member.

A second cutting blade can be provided and coupled to the first and second elongated members whereby when one of the first and second elongated member is moved in the longitudinal direction relative to the other first and second elongated members, the second cutting blade moves in a radial direction. The cutting blades can be positioned so that they are on opposite sides of a plane which is normal to the longitudinal axis. The blades can be arranged so that they either moves toward the plane or away from the plane when the first elongated member is moved in the longitudinal direction.

Another embodiment of the device for augering a conical hole includes a first elongated member having a first end and second end extending in a longitudinal direction, a deformable cutting assembly having a cutting section and an integral non-cutting section, the second end of the first elongated member coupled to the cutting assembly. A second elongated member extends along the longitudinal axis and has a first and a second end. The second elongated member second end couples to the non-cutting section of the cutter. One of the first elongated member and the second elongated member is adapted to move in a longitudinal direction relative to the other of the first elongated member and the second elongated member thereby causing the cutting section to deform in a radial direction while the cutting assembly is rotated by the first elongated member.

My invention is also a method for forming a conical hole including the steps of forming a cylindrical hole in a solid medium, placing one of the above described devices for augering a conical hole in the cylindrical hole defined by a cylindrical hole wall, rotating the first elongated member about the longitudinal axis, moving the cutting blade in the radial direction so as to contact the hole wall, and forming a conical hole in the solid medium with the cutting blade.

DESCRIPTION OF THE PREFERRED EMBODIMENTS

Figure 1A:
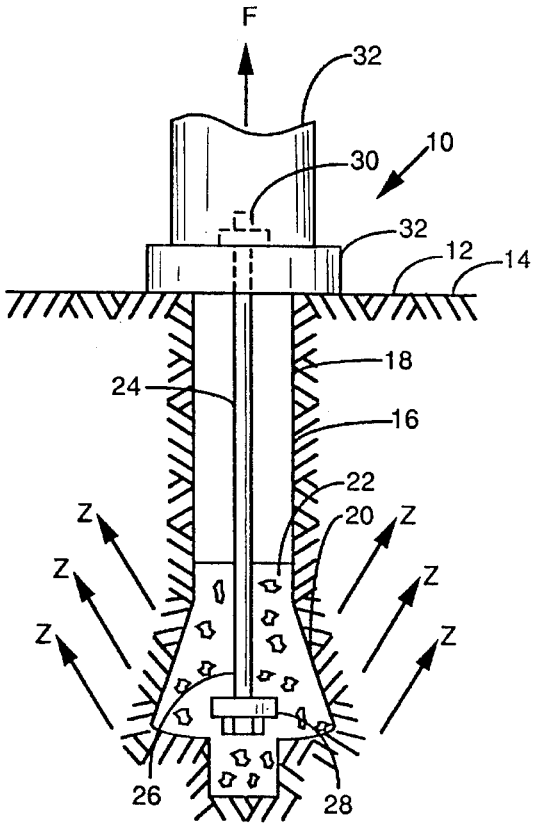
FIG. 1*a* is a partial sectional side view of an anchor for a structure made in accordance with the present invention.

FIGS. 1*a*–1*f* show anchoring and foundation arrangements made in accordance with the present invention. FIG. 1*a* shows an anchoring arrangement 10 in soil or other solid medium 12 (such as, for example, concrete or rock) having a horizontal flat upper surface 14. A hole 16 is augered within the medium 12 having a cylindrical upper portion 18 and a frusto-conical lower portion 20. The term "conical" and "frusto-conical" as used herein can be interchangeable. A concrete base 22 is provided in the lower portion 20 of the hole 16. An anchoring rod 24 passes through the cylindrical upper portion 18 of hole 16 and is embedded at a threaded end 26 in the concrete base 22. A plate and nut arrangement 28 is secured to end 26 and is also embedded in the concrete base 22. The anchoring rod 24 also includes an upper threaded end 30 that extends outside of the hole 16. A base 32, such as a plate, and a nut are threadably secured to bar end 30. A structural member 34, such as a tower guy, attaches to the base 32. Hence, the structural member 34 is anchored to the soil 12. Anchoring arrangement 10 results in a stronger anchor over the prior art anchors, which rely only on a concrete plug in a cylindrical hole. The strength of the anchor arrangement 10 to resist a force F applied to the structural member 34 is obtained directly from the frusto-conical plug contacts the adjacent medium as opposed to frictional forces generated between the augered hole wall contacting the prior art cylindrical plugs. Further, the anchoring arrangement has a greater Zone of Influence Z as compared to the prior art cylindrical plug arrangement.

Figure 1B:
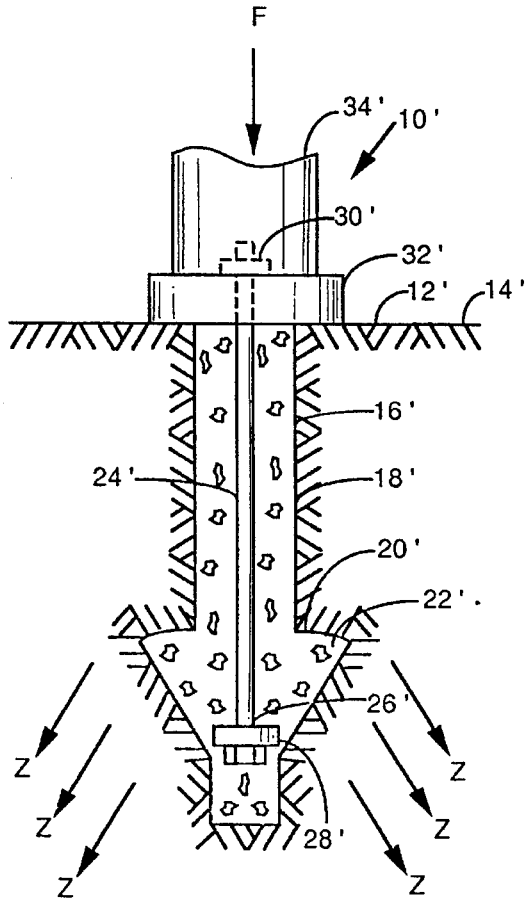
FIG. 1*b* is a partial sectional side view of a foundation for a structure made in accordance with the present invention.

FIG. 1*b* shows a foundation arrangement 10' in soil or other solid to semi-solid medium 12' such as rock, compacted clay, compacted gravel, etc. The foundation arrangement 10' is similar to the anchor arrangement 10 with the exception of the orientation of the frusto-conical lower portion 20 of hole 16. Specifically, the arrangement 10' includes a hole 16' having an upper portion 18' and a frusto-conical lower portion 20'. A concrete plug 22' is provided in the hole 16'. A lower end 26' of a rod 24' is embedded in the concrete plug 22'. A plate and nut arrangement 28' is secured to rod 24'. A load bearing support plate 32' rests on an upper surface of plug 22'. Support plate 32' is secured to rod 24' by a nut on end 30' of rod 24'. A structural member 34', such as a load bearing column, is attached or rests on plate 32'. Strength of the foundation is obtained through a direct bearing load. The lower bearing surface of the frustoconical plug 22' results in an increased load bearing Zone of Influence Z in the medium over the prior art cylindrical plug foundations.

Figure 1C:
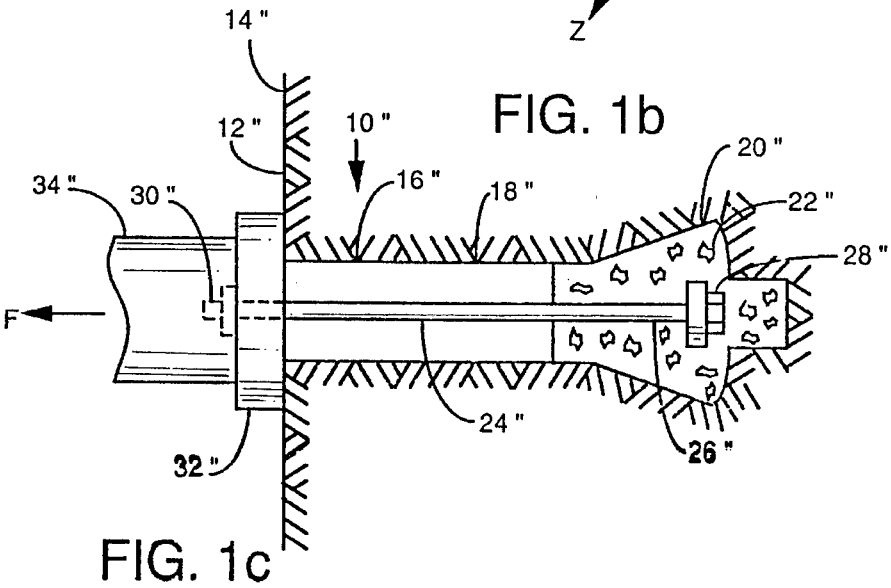
FIG. 1*c* is a partial sectional side view of an anchor for a structure attached to a hillside made in accordance with the present invention.

FIG. 1*c* shows an anchoring arrangement 10" made in accordance with the present invention and is similar to that shown in FIG. 1*a* except that the structural member is secured to a vertical surface as opposed to a horizontal flat surface. Like reference numerals are used for like parts.

Figure 1D:
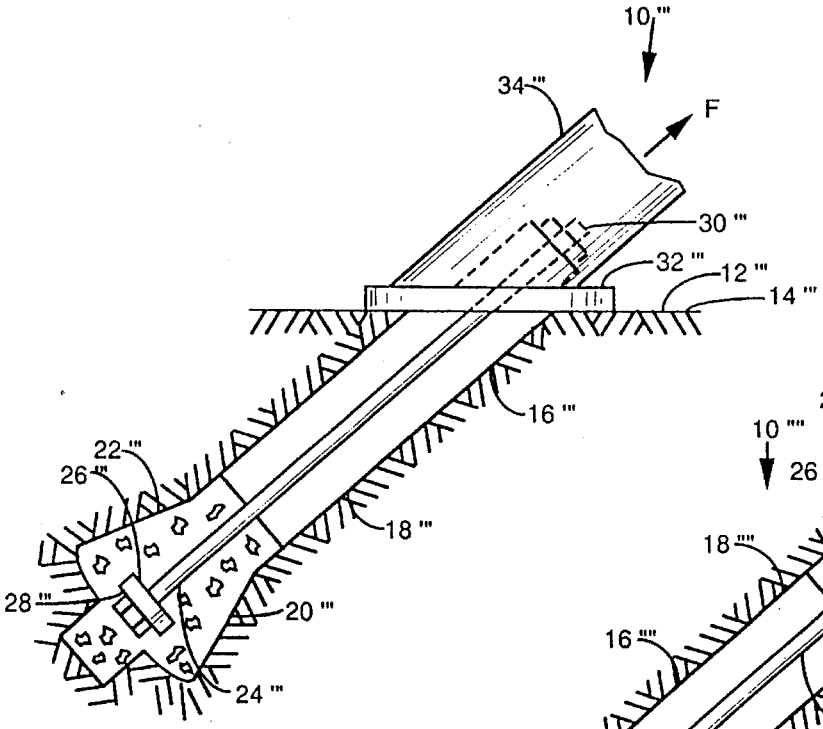
FIG. 1*d* is a partial sectional side view of an anchor for an angled structure made in accordance with the present invention.

FIG. 1*d* shows an anchoring arrangement 10''' made in accordance with the present invention and is similar to that shown in FIG. 1*a* except that the structural member and the hole are angled with respect to the surface of the medium 12. Like reference numerals are used for like parts.

Figure 1E:
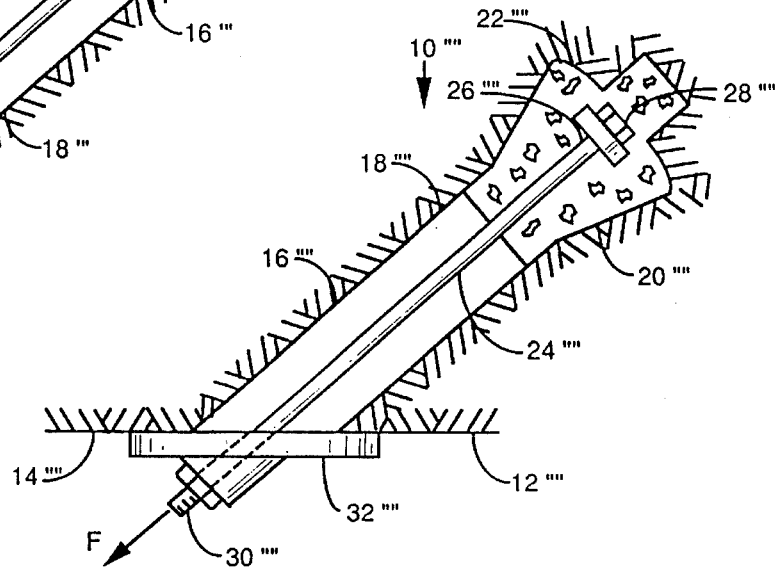
FIG. 1*e* is a partial sectional side view of a mine roof bolt anchor made in accordance with the present invention.

FIG. 1*e* shows an anchoring arrangement 10'''' for use in a mine roof 14'''. Wherein the medium 12'''' can be, for example, coal or rock A hole 16'''' which is formed in a mine roof 14''' extends in an upwardly angled direction into medium 12''''. Hole 16'''' includes a cylindrical portion 18'''' and a frusto-conical portion 20''''. A mine roof bolt 24'''' is received within the hole 16'''' and is held in place by a grouting material 22'''' received within the frusto-conical portion 20''''. A plate and nut arrangement 28'''' is secured to the bolt 24'''' at a bolt end 26''''. The arrangement 28'''' is also embedded in the grouting material 22''''. A bearing plate 32'''' is secured to another end 30'''' of the bolt 24'''' by a nut. The bearing plate 32'''' then abuts against the mine roof 14''''.

Figure 1F:
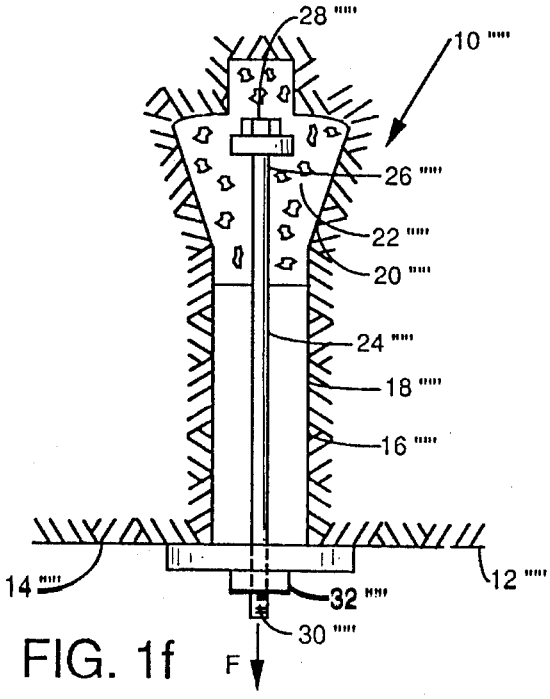
FIG. 1*f* is a partial sectional side view of another mine roof bolt anchor made in accordance with the present invention.

FIG. 1*f* shows an anchoring arrangement 10''''' similar to that shown in FIG. 1*e* except the hole is vertical as opposed to angled. Like reference numerals are used for like elements.

The anchors and foundation shown in FIGS. 1*a*–1*f* work exceedingly well because of the frusto-conical portions of the augered holes, which distribute load into the surrounding media. However, standard augers and drills cannot create the frusto-conical holes as shown in FIGS. 1*a*–1*f*. It should be noted that FIGS. 1*c*–1*f* could be made as foundations by inverting the frusto-conical portions of the holes, similar to that of FIG. 1*b*.

Figure 2:
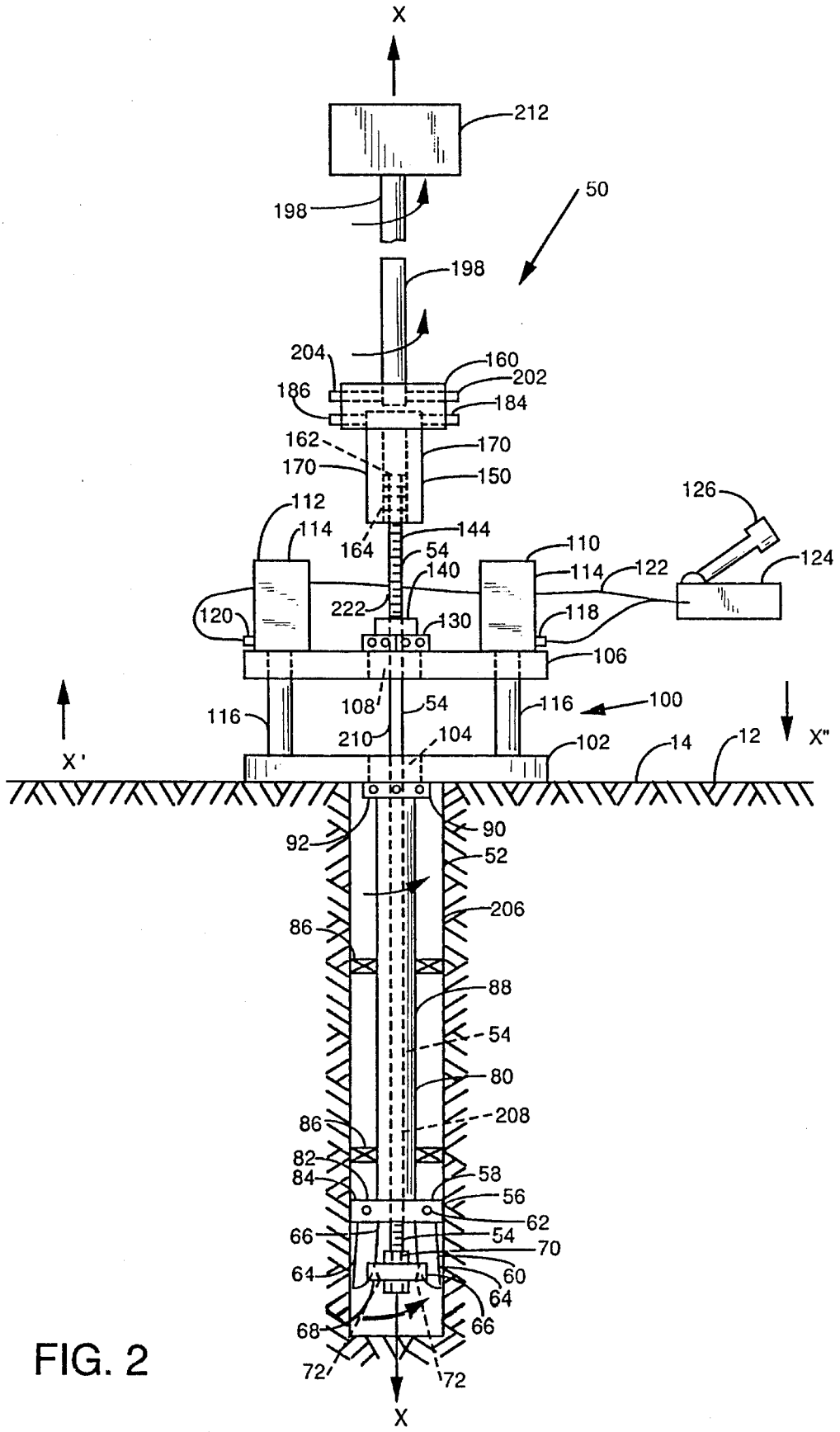
FIG. 2 is a partial sectional side view of a device for augering a conical hole in solid media made in accordance with the present invention prior to augering a conical hole for anchoring.
Figure 3:
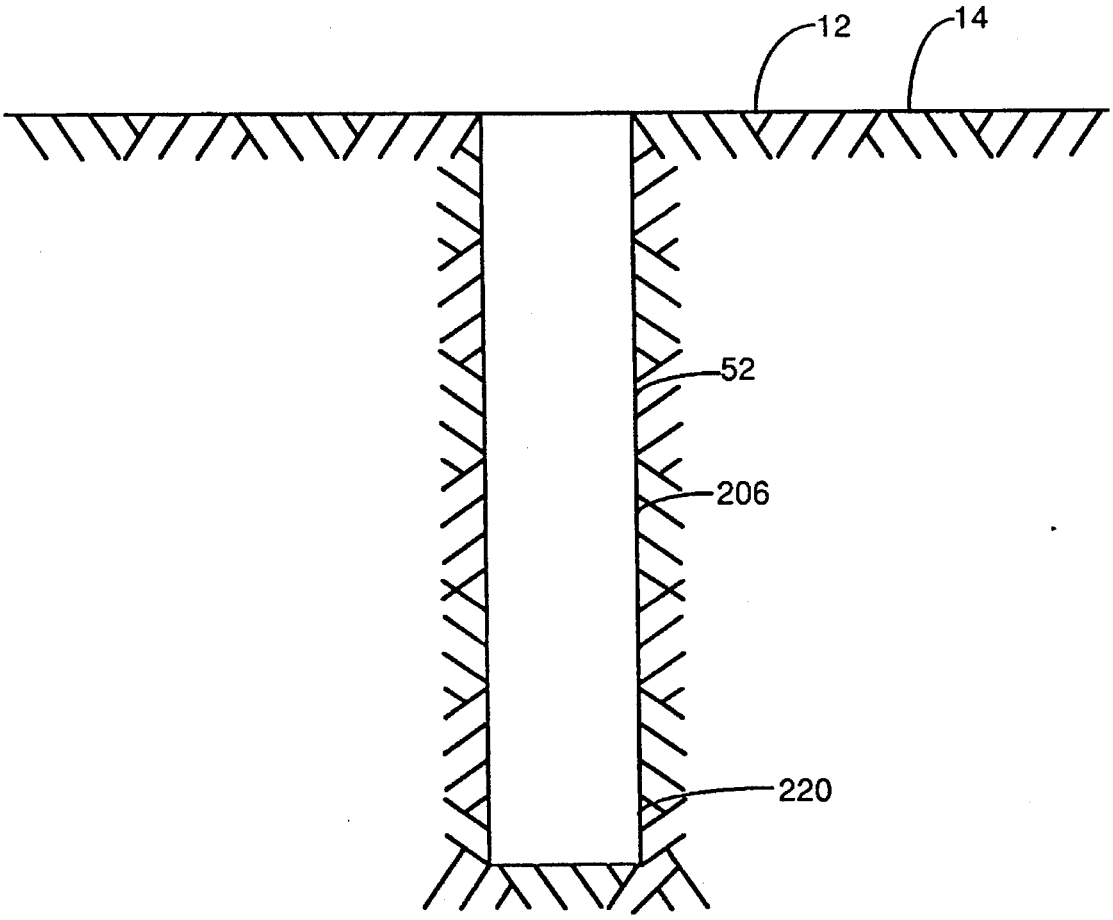
FIG. 3 is a cross-sectional side view of a portion of soil or other medium having an augered cylindrical hole formed therein.
Figure 4A:
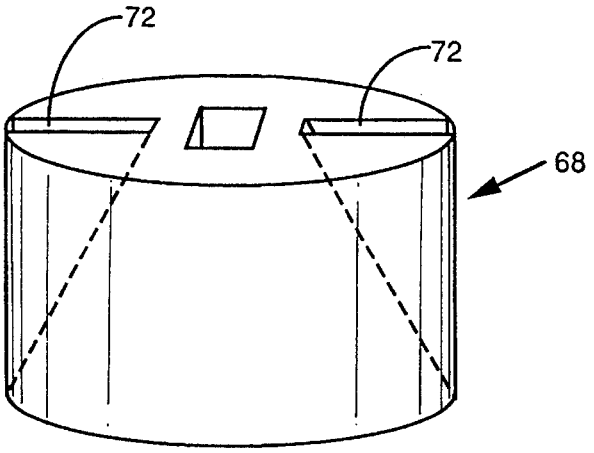
FIG. 4*a* is a perspective view of a plug of the device shown in FIG. 2.
Figure 4B:
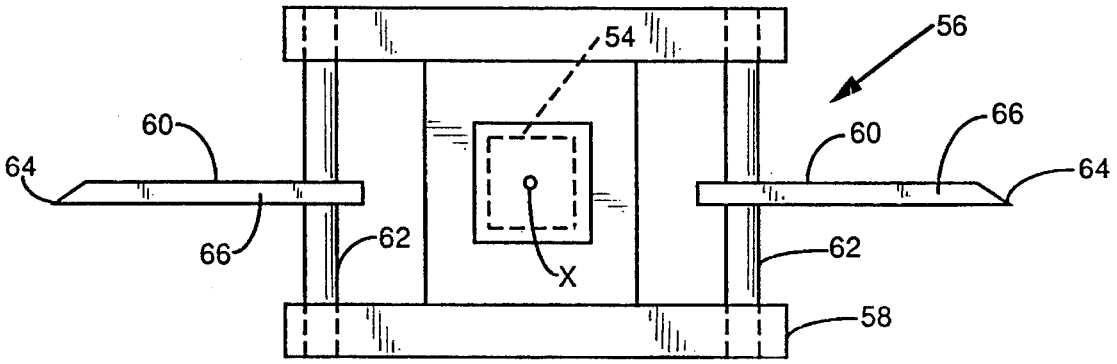
FIG. 4*b* is a top view of a pivot plate assembly of the device shown in FIG. 2.

FIG. 2 shows a device for augering a conical hole in a solid media 50 made in accordance with the present invention. Device 50 converts a standard augered cylindrical hole 52, as shown in FIG. 3, into a cylindrical hole having a frusto-conical hole, such as those shown in FIGS. 1*a*–1*f*. Device 50 includes an elongated rod or a first elongated member 54 extending along a longitudinal X axis, which can take the form of various cross sections, such as circular or square. A lower portion of the rod 54, which has a square cross section, passes through a pivot plate assembly 56 as shown in FIG. 4*b*.

Pivot plate assembly 56 includes a substantially rectangular shaped pivot plate 58, and a plurality of cutting blades 60 pivotally secured to pivot plate 58 through pivot pins 62. A square hole is defined in the pivot plate 58 through which the square lower portion of rod 54 passes. Pivot plate 58 can also be circular shaped. Cutting blades 60 include a cutting section 64 and a non-cutting section 66. A plug 68 is secured to a threaded lower end 70 of rod 54 by two nuts (welded to rod 54) sandwiching plug 68 so that plug 68 contacts blades 60. As shown in FIGS. 2 and 4*a*, a plurality of slots 72 are defined by plug 68. Non-cutting sections 66 are received by respective slots 72 defined in plug 68. Hence, blades 60 are coupled to rod 54 through plug 68. Further, the square hole in pivot plate 58 is slightly larger than the square lower end of rod 54, so that the rod 54 can move in the longitudinal X' direction relative to plate 58. Sides of rod 54 will contact a hole defining surface 73 defining the square hole of plate 58 when rod 54 is rotated about the X axis so that both plate 58 and rod 54 will rotate together about the X axis. The rod 54 is drawn in phantom in FIG. 4*b*. Cutting sections 64 of respective blades 60 are adapted to extend radially outwardly from plug 68. Pivot plate assembly 56 and plug 68 form a cutting assembly 74. Any number of blades 60 can be used with device 50, for example one, two (as shown), three, four or more. The blades 60 should be evenly spaced about the pivot plate 58. Likewise, plug 68 would have to be modified to have enough slots to accommodate the blades 60.

A shroud or elongated member 80 (which is a hollow elongated cylindrical shaft extending along the longitudinal X axis) has a lower end 82 secured to an upper surface 84 of pivot plate 58 on an opposite side from which blades 60 extend. Shroud 80 is positioned above pivot plate 58 and plug 68. Hence, shroud 80 is coupled to blades 60 so that blades 60 are pivotally secured thereto. Rod 54 passes through the shroud 80. Centering rings or bearings 86 are positioned about an outer surface 88 of the shroud 80 and are adapted to center blades 60 within augered hole 52. A first thrust bearing 90 attaches to an upper end 92 of cylindrical shroud 80.

A hydraulic unit assembly 100, which is adapted to move rod 54 in the X' direction, is secured to thrust bearing 90. Hydraulic unit assembly 100 includes a first bearing plate or base 102 having a hole 104 passing therethrough and a second bearing plate 106 having a hole 108 passing therethrough and coaxial with hole 104 defined in bearing plate 102. Bearing plate 102 is substantially parallel to bearing plate 106. Bearing plate 102 attaches to thrust bearing 90 so as to sandwich thrust bearing 90 between bearing plate 102 and shroud 80. Thus, thrust bearing 90 is coupled to bearing plate 102 and shroud 80; and shroud 80 is rotatably coupled to bearing plate 102.

Hydraulic unit assembly 100 also includes two hydraulic cylinder units 110 and 112 secured to bearing plates 102 and 106. Each unit 110 and 112 includes a hydraulic cylinder 114 mounted to bearing plate 106 and a piston arm 116 moveable within cylinder 114 and secured to bearing plate 102 and slideably received by cylinder 114. Piston arms 116, a portion of which also extend out of respective cylinders 114, pass through respective holes in plate 106. Nipples 118 and 120 are secured to the respective cylinders 114 for charging hydraulic fluid thereto. A hydraulic hose 122 is coupled to respective nipples 118 and 120 and to a hand pump 124 having a handle 126.

Hydraulic fluid is provided to cylinders 114 and the hose 122. Movement of handle 126 increases the hydraulic fluid pressure in hose 122 and the amount of hydraulic fluid entering cylinders 114 thereby forcing piston arms 116 to extend outwardly away from cylinders 114 thereby forcing the bearing plates 102 and 106 to move apart from each other in a longitudinal direction. Of course, decreasing the hydraulic fluid pressure will cause piston arms 116 to retract within cylinders 114. In other words, a change in the hydraulic pressure in the cylinders 114 changes the distance between the bearing plates 102 and 106.

A thrust bearing 130 is secured to an upper surface of bearing plate 106. Rod 54 passes through holes 104 and 108, and thrust bearing 130. A restrainer nut or member 140 is secured to rod 54 and rests on an upper surface 142 of thrust bearing 130 so that thrust bearing 130 couples the rod 54 through nut 140 to bearing plate 106. An upper end 144 of rod 54 is received by a lower end of a cylindrically shaped slide socket 150. A kelly bar adapter 160 is secured to an upper end of slide socket 150. Although, as shown, rod 54 includes a lower portion having a square cross section and an upper portion having a circular cross section, the entire rod could have a square cross section.

Figure 5:
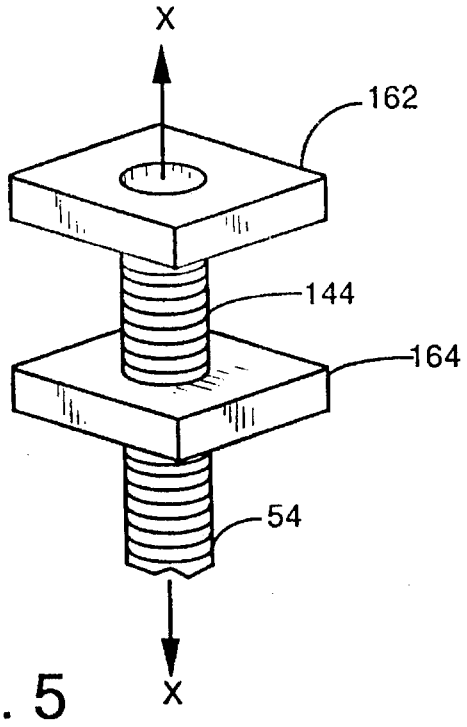
FIG. 5 is a perspective view of an upper end of a rod of the device shown in FIG. 2.
Figure 6:
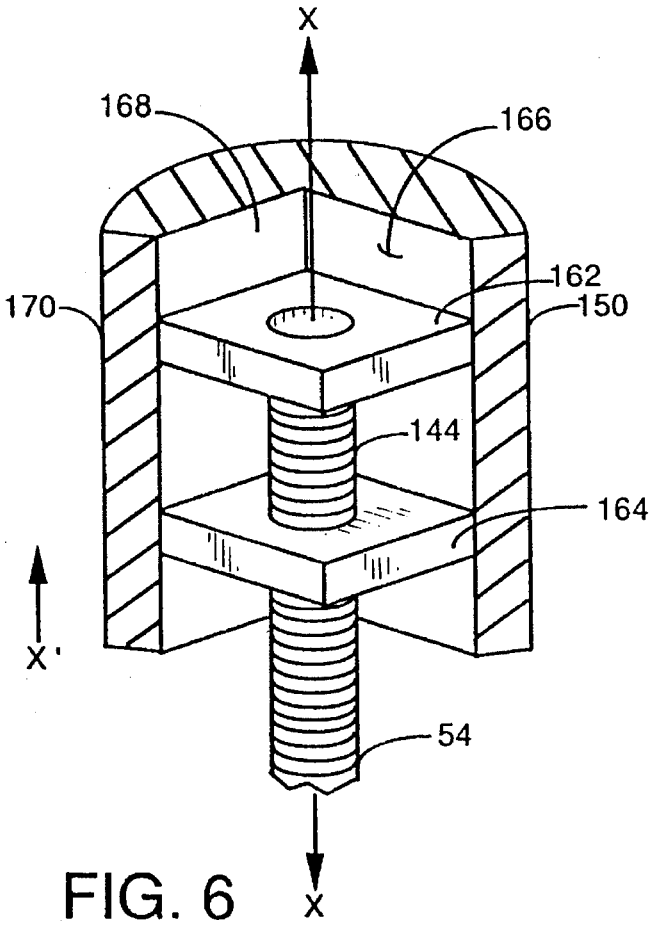
FIG. 6 is a partial cross-sectional perspective view of a slide socket and the upper end of the rod shown in FIG. 5.
Figure 7:
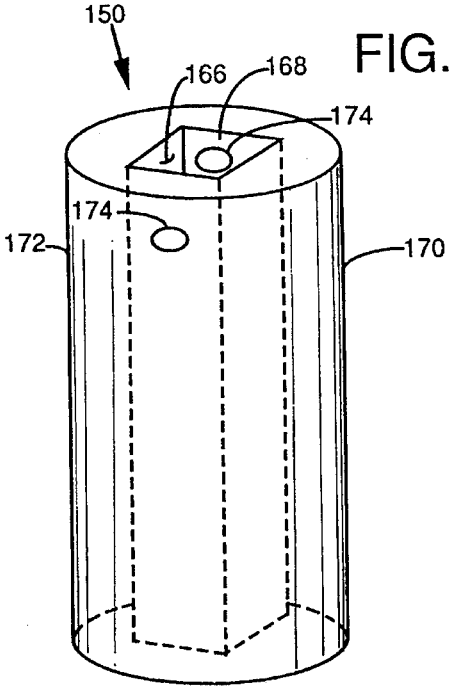
FIG. 7 is a perspective view of the slide socket shown in FIG. 6.

FIGS. 5–10 show slide socket 150 and kelly bar adapter 160 in more detail. As shown in FIGS. 5 and 6, two spaced apart substantially square-shaped guide nuts 162 and 164 are wielded to upper end 144 of rod 54. Guide nuts 162 and 164 pass through a lower open end of socket 150 and are slidably received by the slide socket 150 so that upper end 144 of rod 54 can move in the longitudinal X' direction relative to slide socket 150. Essentially, slide socket 150 is a sleeve having an open end through the upper end of rod 54 passes. As shown in FIG. 6, guide nuts 162 and 164 are received within a rectangularly shaped cavity 166 defined by an inner surface 168 of slide socket 150. Inner surface 168 has a substantially square cross-sectional shape, which is slightly larger than the outer perimeter of the guide nuts 162 and 164, so that the guide nuts 162 and 164 are slideably received by slide socket 150. An outer surface 170 of slide socket 150 is substantially cylindrical in shape. As shown in FIG. 7, an upper portion 172 of slide socket 150 includes two pin holes 174, which are coaxial with each other and spaced 180 degrees apart.

Figure 8:
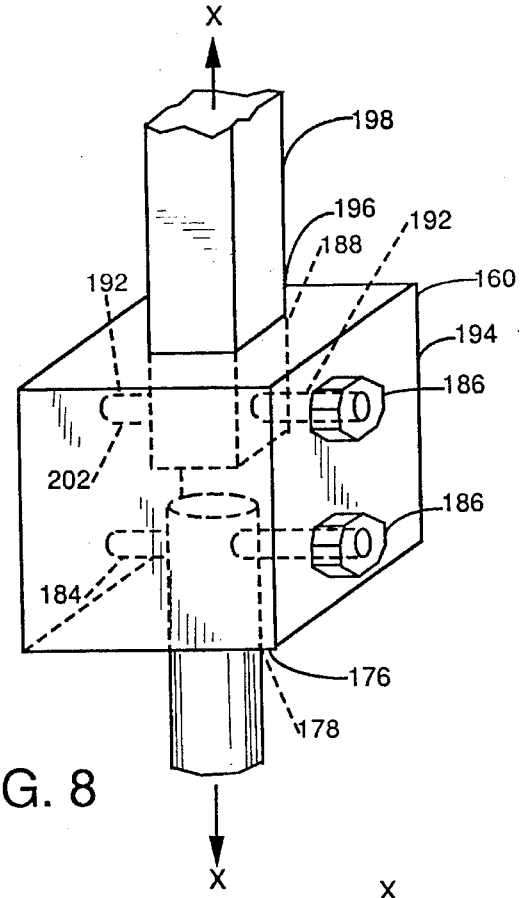
FIG. 8 is a perspective view of a kelly bar adapter, kelly bar and slide socket of the device shown in FIG. 2.
Figure 9:
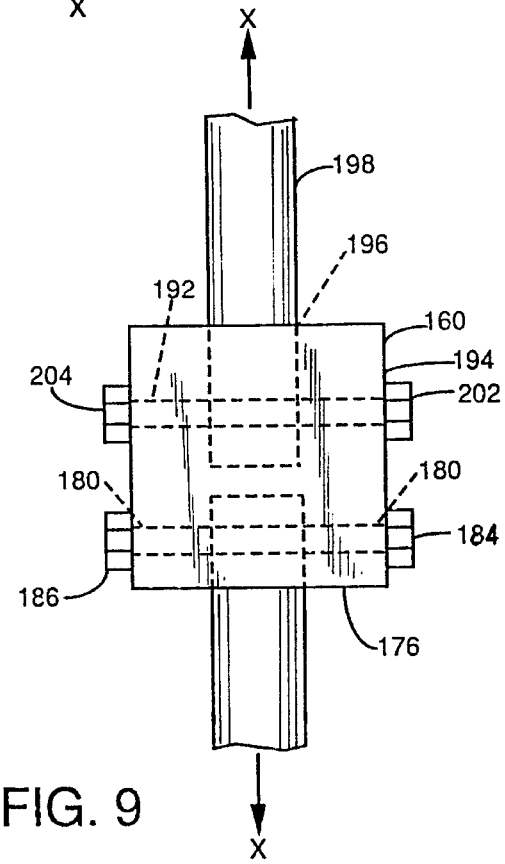
FIG. 9 is a side view of the arrangement shown in FIG. 8.

FIGS. 8 and 9 show kelly bar adapter 160 secured to the slide socket or coupler 150. Kelly bar adapter 160 is substantially rectangular in shape having a lower surface 176 defining a slide socket receiving cavity 178. Two coaxial holes 180 are defined in a lower portion 182 of kelly bar adapter 160. Upper portion 172 of slide socket 150 is received by kelly bar adapter 160 through cavity 178 so that pin holes 174 are aligned with holes 180. A fastener bolt 184 passes through the respective aligned holes 174 and 180 thereby securing slide socket 150 to the kelly bar adapter 160. A nut 186 is then threadably received by bolt 184 so as to hold bolt 184 in place. A kelly bar receiving cavity 188 is defined by an upper surface 190 of kelly bar adapter 160. Cavity 188 has a substantially square profile, which corresponds to the profile of a kelly bar. Two coaxial holes 192 are located in an upper portion 194 of kelly bar adapter 160. A lower end 196 of a kelly bar 198 is slideably received by kelly bar adapter 160 through cavity 188. Kelly bar 198 has a substantially square cross-sectional shape. A fastening bolt receiving hole (not shown) is defined in a lower portion 200 of kelly bar 198 and is coaxially aligned with holes 192. A fastening bolt 202 passes through coaxial holes 192 securing kelly bar 198 to kelly bar adapter 160. A nut 204 is threadably received by bolt 202 so as to hold bolt 202 in place. Hence, the kelly bar adapter 160 couples the kelly bar 198 to the rod 54.

Figure 10:
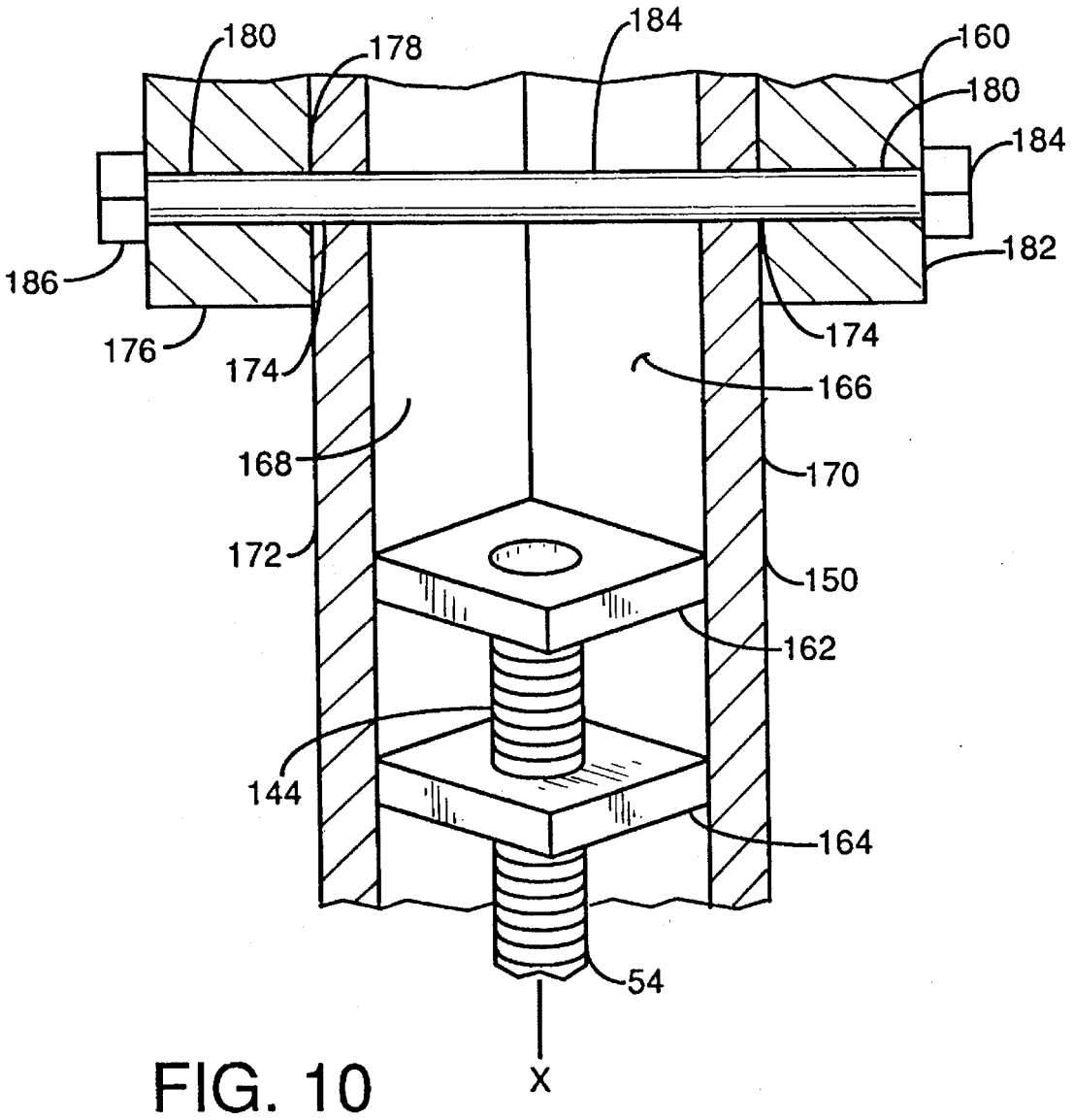
FIG. 10 is a partial cross-sectional side view of the kelly bar and slide socket shown in FIG. 8.

As can be seen in FIGS. 8–10, slide socket 150, kelly bar adapter 160 and kelly bar 198 coact with each other, so that rotating the kelly bar 198 about the longitudinal X axis also rotates kelly bar adapter 160, slide socket 150 and rod 54 about the X axis. Specifically, rotational torque applied to kelly bar 198 passes to the kelly bar adapter 160 through bolt 202, which passes to slide socket 150 through bolt 184, and which passes to rod 54 through guide nuts 162 and 164, contacting inner surface 168 of slide socket 150.

Figure 11:
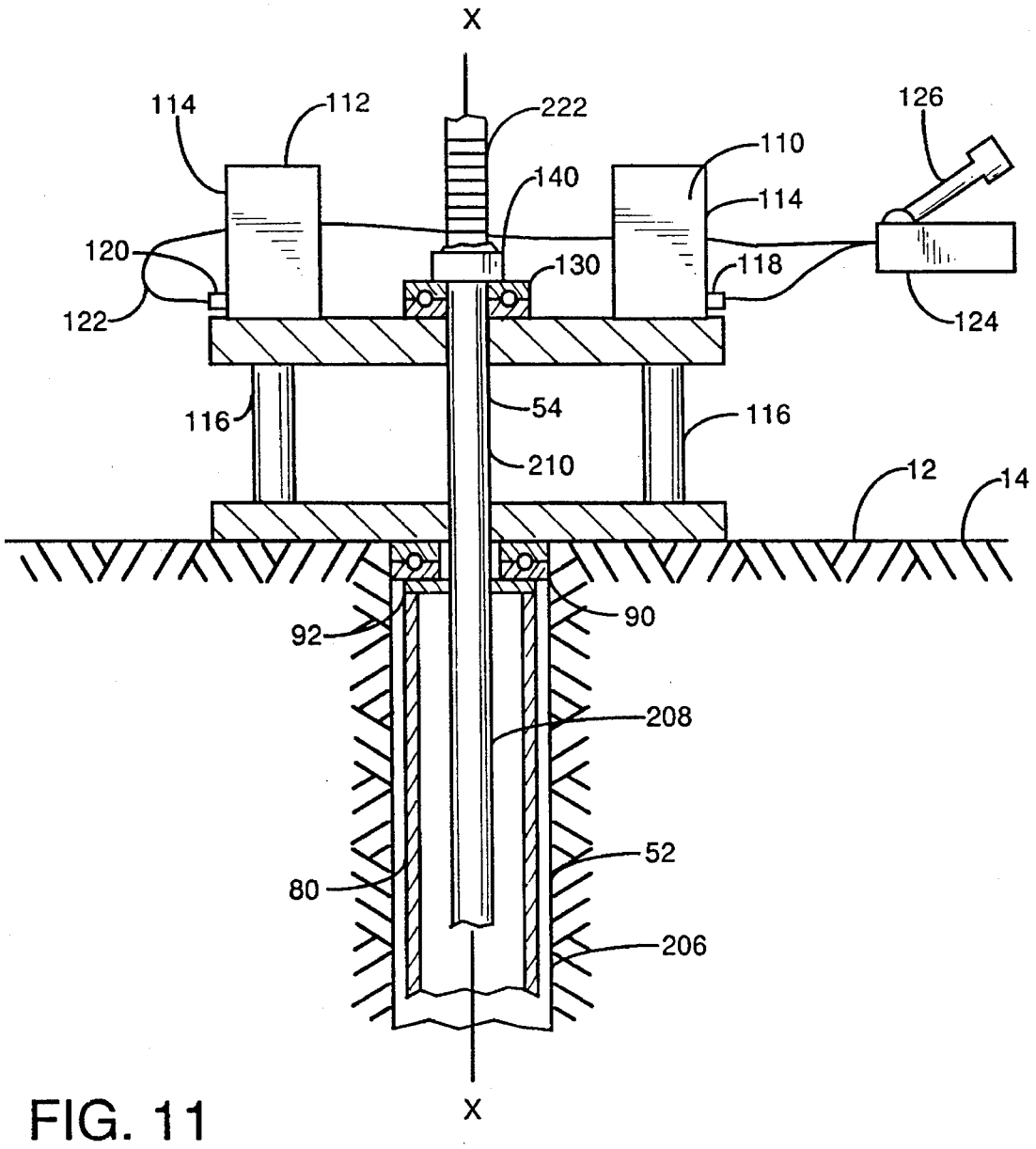
FIG. 11 is a partial sectional side view of the device shown in FIG. 2.

Operation of device 50 is as follows. Initially, as shown in FIG. 3, cylindrical hole 52 defined by a hole surface 206 in medium 12, such as soil, is formed in the soil by an auger. Referring to FIGS. 2 and 11, bearing plate 102 is then placed on an upper surface 14 of soil 12 over augered hole 52 so that a lower portion 208 of rod 54, pivot plate assembly 56, plug 68 and shroud 80 are placed within hole 52. Centering rings 86 are sandwiched between augered hole surface 206 and shroud 80. An upper portion 210 of rod 54, hydraulic unit assembly 100, slide socket 150, kelly bar adapter 160 and kelly bar 198 are positioned above augered hole 52. A motor 212 is coupled to kelly bar 198 so as to rotate kelly bar 198 about the X axis. Motor 212 is then activated rotating kelly bar 198 about the X axis, which in turn rotates kelly bar adapter 160, slide socket 150 and rod 54 about the X axis. More specifically, the inner surface 168 of slide socket 150 contacts or coacts with guide nuts 162 and 164 thereby forcing rod 54 to rotate about the X axis when slide socket 150 is rotated about the X axis. Restrainer nut 140 likewise rotates about the X axis and abuts against an upper surface of thrust bearing 130. A lower surface of thrust bearing 130 coacts with bearing plate 106 whereby bearing plate 106 does not rotate.

Plug 68, which is secured to the lower end 70 of the rod 54 rotates about the X axis, which in turn rotates pivot plate assembly 56 via blades 60 about the X axis. Plug 68 is coupled to blades 60 via slots 72. Likewise, pivot plate 58 is also rotated about the X axis by rod 54 contacting the pivot plate hole defining surface 73. Shroud 80 likewise rotates about the X axis, since it is secured to pivot plate 58. Centering rings 86 likewise rotate about the X axis. Plate 102 does not rotate since shroud 80 and bearing plate 102 are coupled to an upper surface of thrust bearing 90. Hence, by the use of the thrust bearings 90 and 130, the hydraulic unit assembly 100 does not rotate.

Next, cylinders 114 of units 110 and 112 are pressurized by reciprocally moving the handle 126 of pump 124 so as to extend piston arms 116. Piston arms 116 coact with an upper surface of bearing plate 102 moving bearing plate 106 and thrust bearing 130 away from bearing plate 102 in an upwardly direction X'. Restrainer nut 140 likewise moves in the upwardly direction X' as does rod 54. Upper end 144 of rod 54 moves or slides in the upward direction X' within cavity 166 of slide socket 150. Shroud 80, slide socket 150, kelly bar adapter 160, kelly bar 168 and motor 212 do not move in the upward direction X'. Hence, rod 54 moves in the upwardly direction X' relative to shroud 80.

Figure 12:
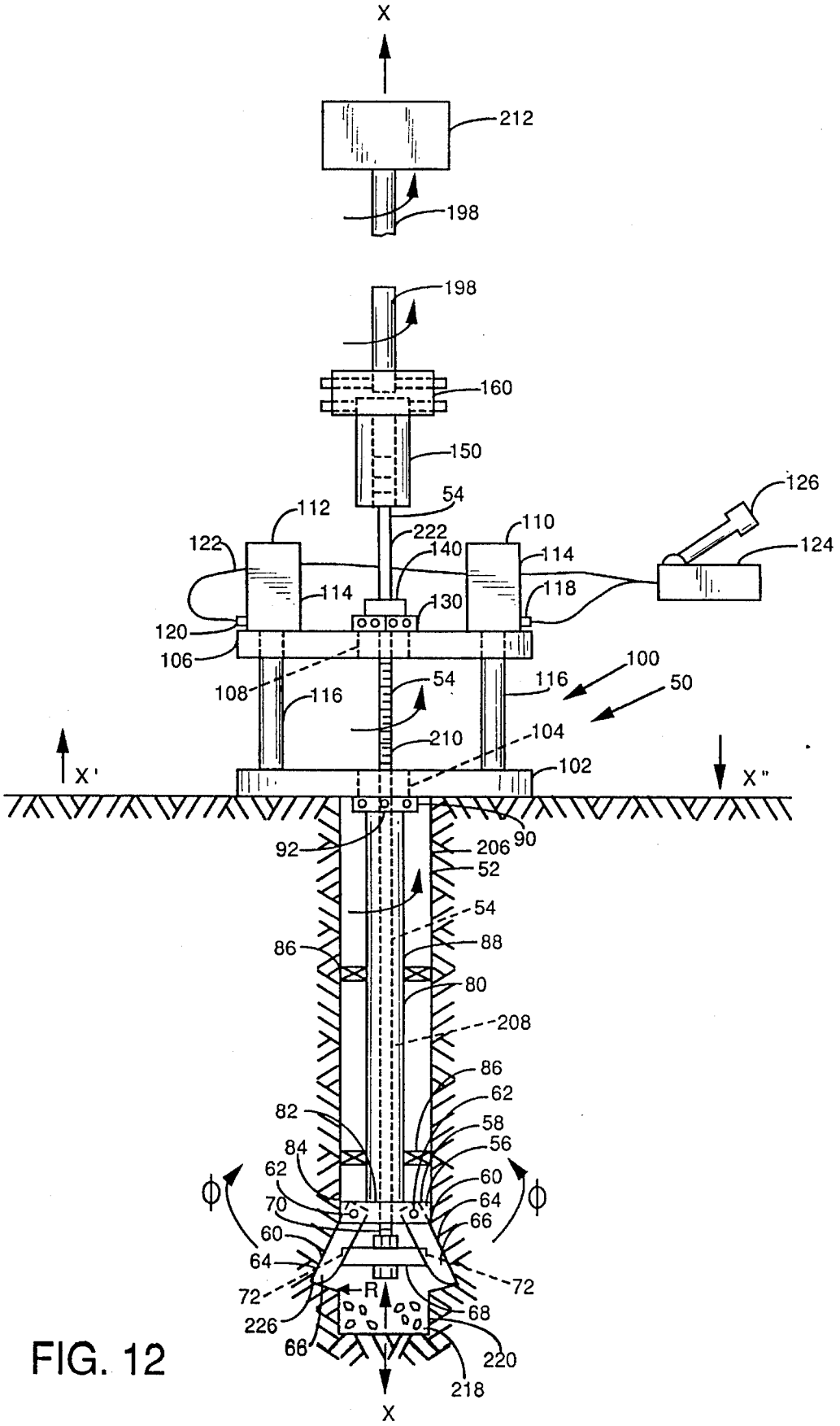
FIG. 12 is a partial sectional side view of the device shown in FIG. 2 augering a conical hole for anchoring.
Figure 13:
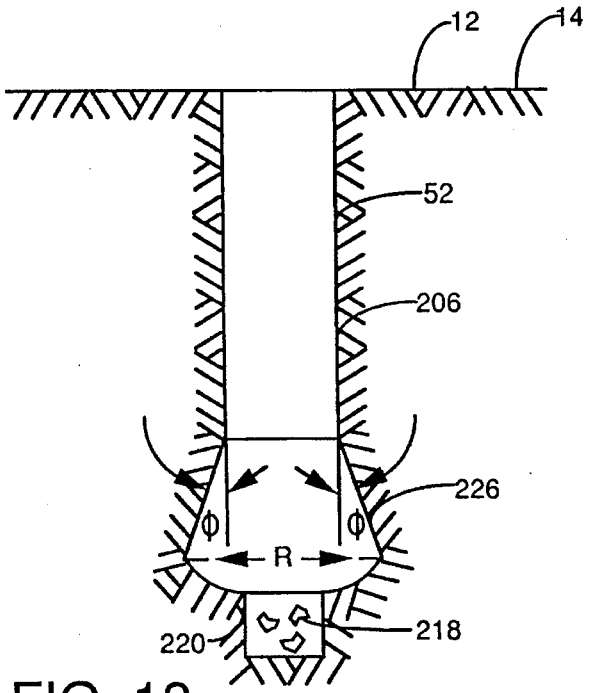
FIG. 13 is a cross-sectional side view of a portion of soil or other media having a frusto-conical hole for anchoring formed therein by the device shown in FIG. 2.

As shown in FIG. 12, plug 68, which is secured to rod 54, moves in the upward direction X'. Plug 68 abuts or coacts against blade non-cutting sections 66 and forces blades 60 to pivot upwardly about the pivot pins 62. This causes blades 60 to pivot or move in the radial direction R and contact hole surface 206. Hence, blades 60 pivot in the radial direction R relative to rod 54 and shroud 80. Continued pumping of handle 126 forces rod 54 in the upward direction X' and causes the blades 60 to extend radially in the radial direction R. At the same time, blades 60 are rotated about the X axis by motor 212 via rod 54, thereby cutting into hole surface 206 and forming a frusto-conical recess or conical hole 216. The debris or remains 218 of the soil or the medium cut from augered hole surface 206 by the blades 60 fall to a lower portion 220 of augered hole 52. Indica 222 indicates the angle $\phi$ which blades 60 are rotated about the longitudinal axis X. Once the proper frusto-conical recess 216 has been formed, then cylinders 114 are depressurized so that the pistons 116 are retracted within cylinders 114 and bearing plate 106 and bar 54 move downwardly in the X" direction toward bearing plate 102. Blades 60 then pivot about pivot pins 62 and return to their original position. Motor 212 is then deactivated and device 50 is removed from hole 52, which will have a cylindrical first portion 224 and a frusto-conical second portion 226 as shown in FIG. 13.

The anchored hole can then be filled with concrete or other settable material and an anchoring arrangement, such as anchoring rod 24 and plate and nut arrangement 28, can be placed in the concrete prior to hardening. When the concrete hardens, then an anchor is formed and the base 32 and structural member can be attached to rod 24, as shown in FIG. 1*a*. Anchoring arrangements shown in FIGS. 1*c*–1*f* can be formed in the same manner using a modified device 50 adapted to operate at different orientations. This can easily be accomplished by modifying bearing plate 102 so, in the case of the angled holes, the bearing plate 102 is wedge shaped as opposed to being flat.

Figure 14:
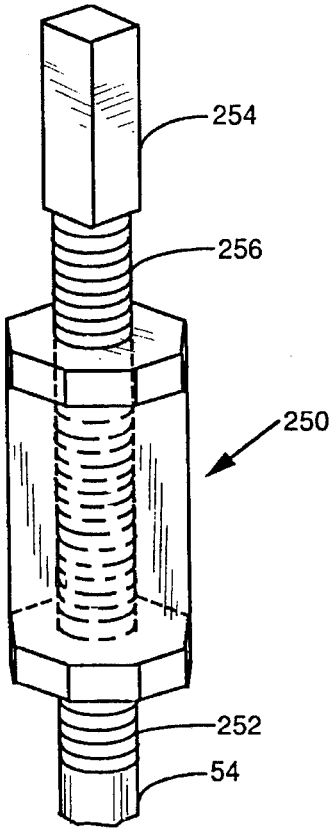
FIG. 14 is a perspective view of an alternative coupling arrangement for the arrangement shown in FIG. 5.
Figure 15:
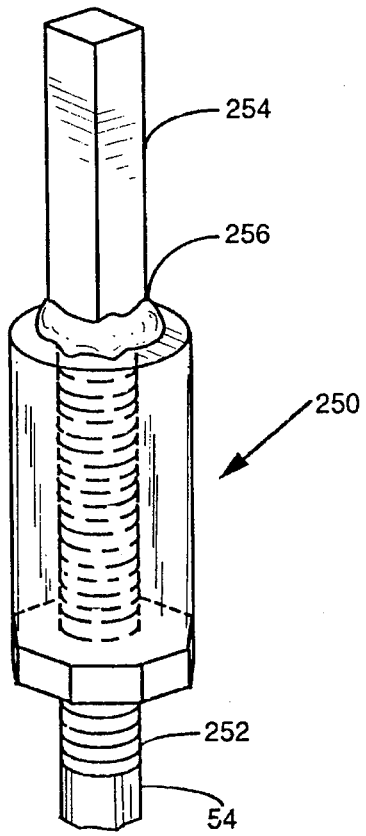
FIG. 15 is a perspective view of another alternative coupling arrangement for the arrangement shown in FIG. 5.
Figure 16:
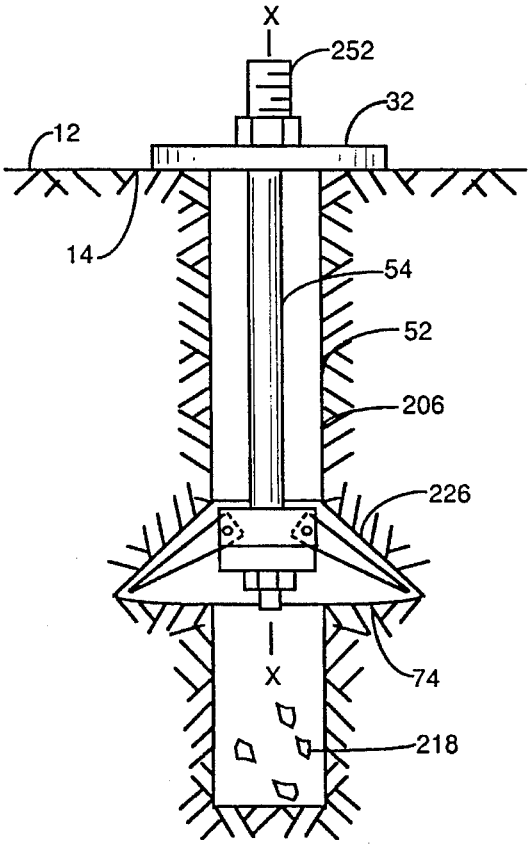
FIG. 16 is a partial sectional side view of an anchor incorporating a pivot plate assembly made in accordance with the present invention.

In some instances, it is preferable to leave the rod 54 and the cutting assembly 74 in hole 52, thereby forming a part of the anchoring assembly. In this case, as shown in FIG. 14, an accessory coupling 250 is provided that is threadably received at one end 252 by upper end 144 of rod 54. A bar 254 having a threaded end 256 is threadably received at another end 258 of coupling 250. Alternatively, as shown in FIG. 15, end 256 can be welded to coupling 250. Bar 254 has a rectangular shaped section 260 with a square cross section that is slideably received within cavity 166 of slide socket 150, and operates in the same manner as guide nuts 162 and 164. In operation, coupling 250 is removed from rod 54 after the frustoconical recess 216 is formed thereby leaving rod 54 and cutting assembly 74 in the hole 52, as shown, for example, in FIG. 16. In this case, it is optional to pour concrete into the hole to form a plug.

Figure 17:
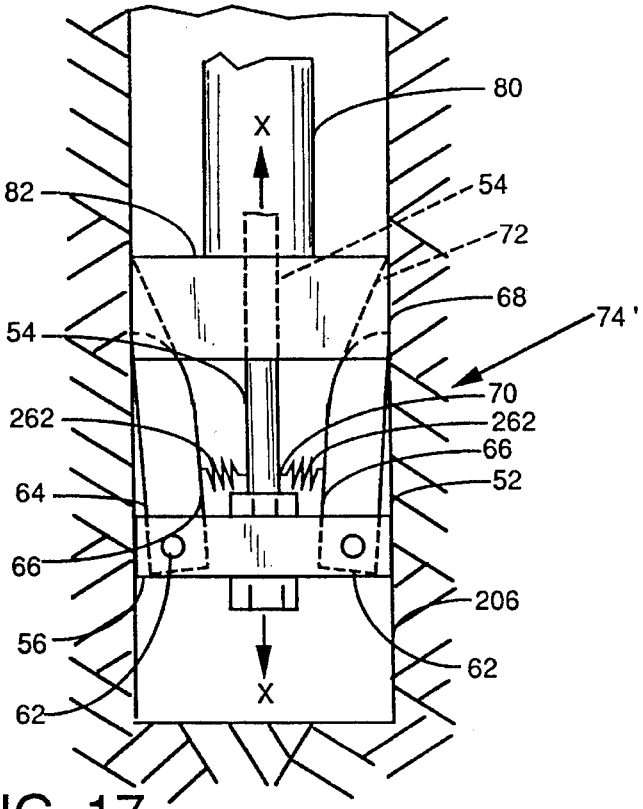
FIG. 17 is a partial sectional side view of a portion of a device for forming a frusto-conical hole for a foundation prior to-the formation of the frusto-conical hole.

Device 50 can also be used to make a frustoconical hole or recess for foundations by replacing cutting assembly 74 with cutting assembly 74' shown in FIGS. 17 and 18 and described below. Like reference numerals are used for like parts. Cutting assembly 74' includes plug 68 attached to lower end 82 of shroud 80. Pivot plate assembly 56 attaches to the lower end 70 of rod 54. This is an opposite arrangement as that for cutting assembly 74 shown in FIG. 2. Tension spring members 262 attach to non-cutting sections 66 of blades 60 and rod 54 so as to bias blades 60 against plug 68.

Figure 18:
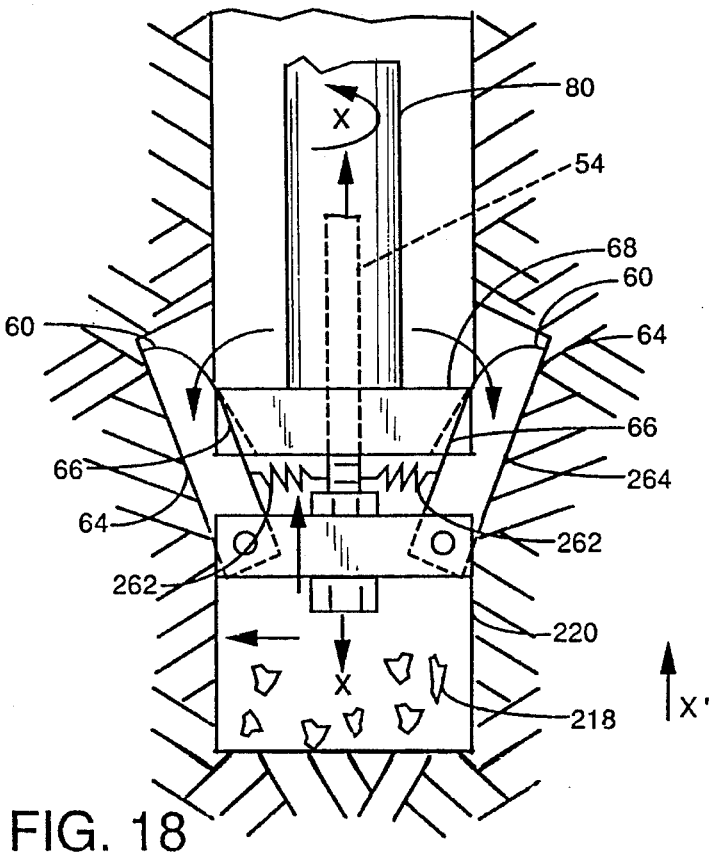
FIG. 18 is a partial sectional side view of the device shown in FIG. 17 forming the frusto-conical hole.
Figure 19:
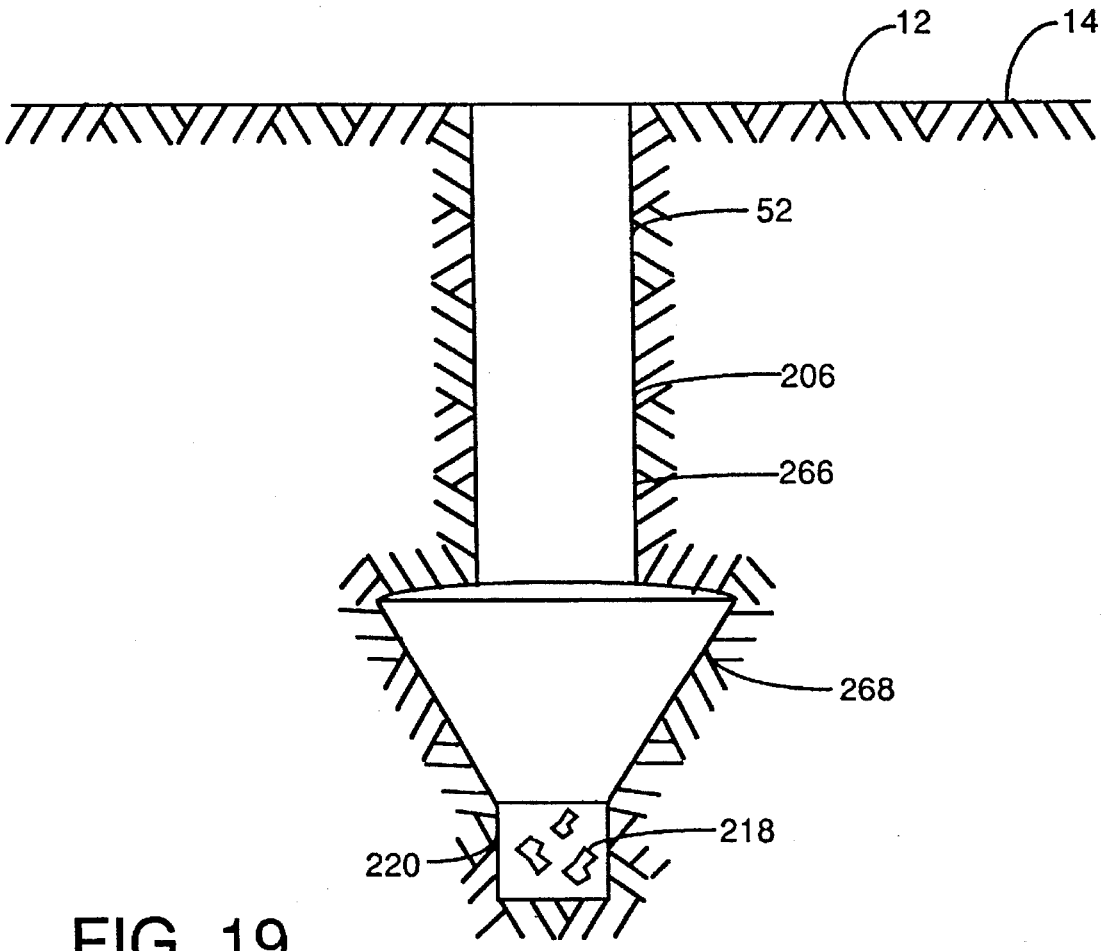
FIG. 19 is a partial sectional side view of a portion of soil or other media having a frusto-conical hole for a foundation formed by the device shown in FIGS. 17 and 18.

As shown in FIG. 18, blades 60 are forced radially and outwardly and cut a frusto-conical hole 264 within augered hole 52 when rod 54 is rotated about the X axis and forced upwardly in the X' direction toward the bearing plate 102 in the same manner as previously discussed. After the frusto-conical hole 264 is cut by blades 60, motor 212 is deactivated and units 110 and 112 are depressurized so that blades 60 pivot into a retracted position, which are assisted by springs 262. The device 50 can then be removed from hole 52, thereby resulting in a hole 52 (as shown in FIG. 19) having a cylindrical first portion 266 and frusto-conical second portion 268. Rod 24' and plate and nut arrangement are placed with the hole and the concrete is poured therein forming plug 22'. Once the concrete hardens, the foundation is formed so that a structural foundation can set thereon.

Figure 20:
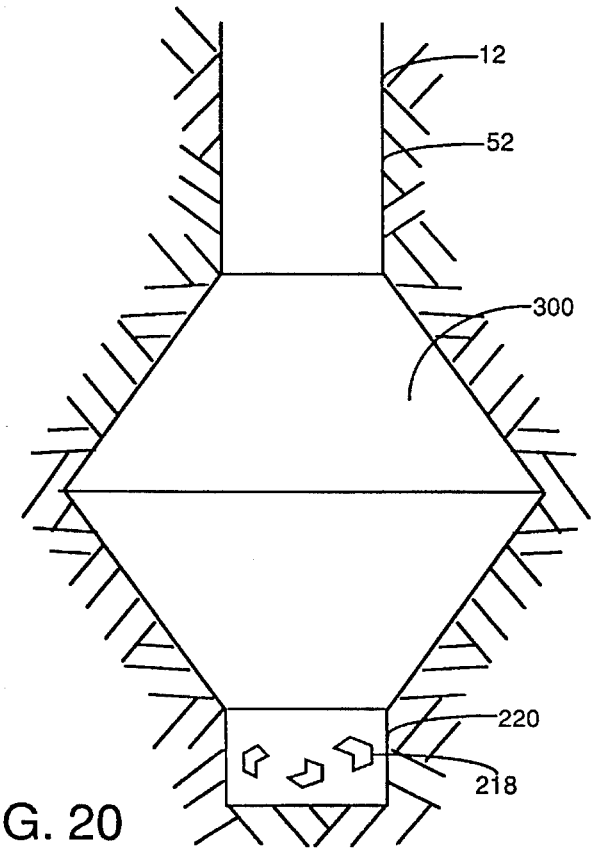
FIG. 20 is a partial sectional side view of a portion of soil or other media having a pair of frusto-conical holes for a foundation and anchor.

In some instances, structural members have both compressive and tensile loads applied to them, whereby the structural member requires both an anchor, as well as a foundation. In that case, a double frusto-conical type hole 300 is required as shown in FIG. 20. Device 50 can also be used to make hole 300 by replacing cutting assembly 74 with cutting assembly 74" shown in FIG. 21 and described below. Like reference numerals are used for like parts. Pivot plate assembly 56 attaches to the cylindrical shroud 80. Rod 54 slideably passes through the pivot plate 58. A second pivot plate assembly 302 is attached to an end of rod 54. (Second pivot plate assembly 302 is similar to pivot plate assembly 56 and includes a pivot plate 304 having a plurality of blades 306 similar to blades 60, pivotally attached thereto by pivot pins 308.) Blades 60 face blades 306. Plug 68 coacts with blades 60 in the same manner as previously described. A plug 310, similar to plug 68, coacts with blades 306 in a similar way as plug 68 coacts with blades 60. Rods 312 are secured to plug 68 and plate 304 and slideably pass through holes formed in plug 310. Rods 314 are secured to plug 310 and plate 58 and slideably pass through holes formed in plug 68. Coaxial holes are formed in plugs 68 and 310 through which rod 54 slideably passes. As can be seen, blades 60 and 306 are positioned on opposite sides of a plane A that is normal to the longitudinal X axis.

In operation, plugs 68 and 310 abut one another so that the cutting sections 64 are substantially parallel to the X axis, so as not to contact the augered hole surface 206. Rod 54 is then moved in the upwardly direction X' and rotated about the X axis so that plug 68 is likewise moved in the upwardly direction X' by plate 304 through rods 312. This causes blades 60 to pivot in the upwardly direction X'. Plug 310, which is attached to plate 58, does not move in the upwardly direction when rod 54 and pivot plate assembly 302 is moved in the upwardly direction, thereby causing blades 306 to move in a downwardly direction X" so that blades 60 and 306 move away from plane A. Hence, this arrangement then can form the hole 300 such as that shown in FIG. 20. Upon completion of the hole, device 50 is removed in a similar manner as previously discussed. The hole can then be filled with concrete and receive a plate and rod arrangement as previously discussed.

Figure 21:
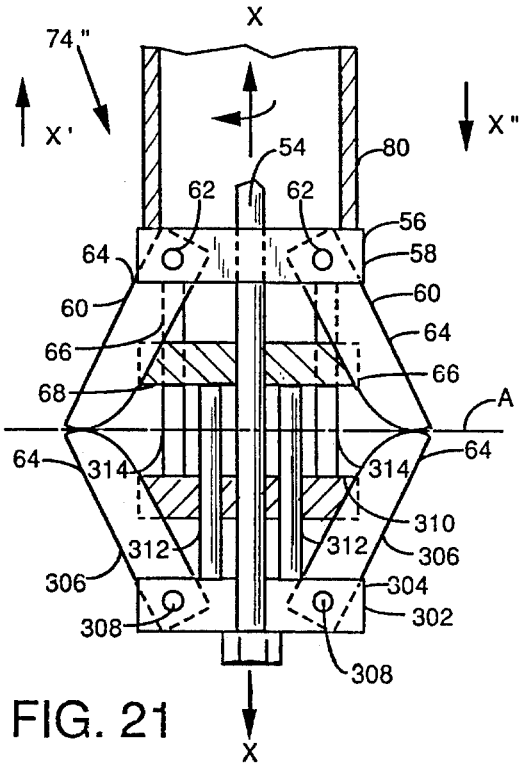
FIG. 21 is a partial sectional side view of a portion of a device for forming the pair of frusto-conical holes shown in FIG. 20.
Figure 22:
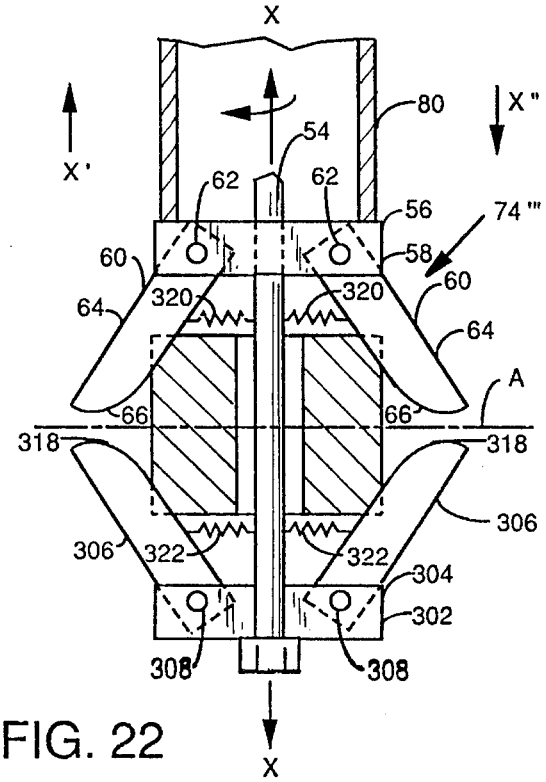
FIG. 22 is a partial sectional side view of a portion of a device for forming the pair of frusto-conical holes shown in FIG. 20.

FIG. 22 shows a cutting assembly 74"' similar to the cutting assembly 74" shown in FIG. 21 with the exception that plugs 68 and 310 and rods 312 and 314 have been replaced by a plug 316, which is essentially plug 68 and plug 310 attached to each other. Rod 54 slideably passes through plug 316, which rests on the non-cutting sections 66 and 318 of blades 60 and 306. Springs 320 and 322 bias blades 60 and 306 against plug 316. In operation, as rod 54 rotates about the longitudinal axis X and moves in the upwardly direction X', plug 316 is forced against blades 60 and 306, thereby pivoting blades 60 and 306 in a similar manner as that for cutting assembly 74" thereby forming a hole 300.

Figure 23:
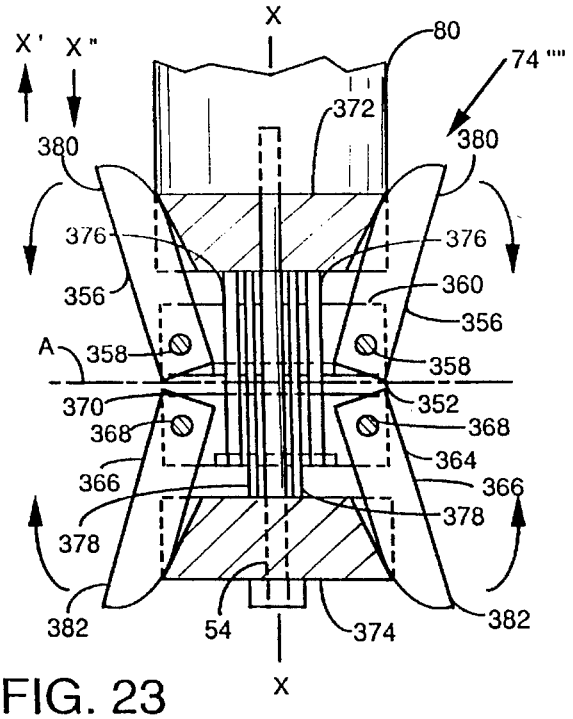
FIG. 23 is a side view of a portion of a device for forming a pair of frusto-conical holes.
Figure 24:
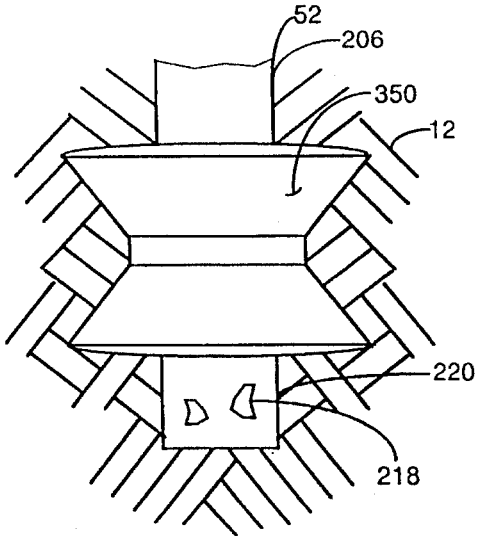
FIG. 24 is a partial sectional side view of a portion of soil or other media having a pair of frusto-conical holes for a foundation and an anchor formed by the device shown in FIG. 23.

FIG. 23 shows a cutting assembly 74"" for device 50 for making a double frusto-conical hole 350, as shown in FIG. 24. Like reference numerals are used for like parts. Pivot plate assembly 352 which is similar to pivot plate assembly 56 includes a set of blades 356 attached by pivot pins 358 to pivot plate 360. Likewise, pivot plate assembly 364 is similar to pivot plate assembly 56 and includes a set of blades 366 attached by pivot pins 368 to pivot plate 370. A plug 372 is attached to a lower end of shroud 80 and a plug 374 is attached to a lower end 70 of rod 54. Rod 54 slideably passes through plates 360 and 368. Plugs 372 and 374 coact with blades 356 and 366 in the same manner as that of plug 68 and blades 60 previously discussed. Rods 376 are secured to plug 372 and pivot plate 370 and slideably pass through holes formed in pivot plate 360. Rods 378 are secured to plug 374 and pivot plate 360 and slideably pass through holes formed in pivot plate 370. As can be seen, blades 356 and 366 are positioned on opposite sides of a plane A that is normal to the longitudinal X axis.

In operation, plates 360 and 370 are spaced apart from one another along the X axis so that cutting sections 380 and 382 of blades 356 and 366 are substantially parallel to the X axis, so as not to contact the augered hole surfaces 206. The non-cutting sections of blades 356 and 366 are received in respective slots of plugs 372 and 374. Rod 54 is then moved in the upwardly direction X' and rotated about the X axis so that plug 374 and pivot plate 360 (through rods 376) are moved in the upwardly direction X' by rod 54. This causes blades 356 to pivot in the downwardly direction X" toward plane A and blades 366 pivot in the upwardly direction X' toward plane A. Hence, this arrangement can then form the hole 350 shown in FIG. 24. Upon completion of the hole, device 50 is removed in a similar manner as previously discussed. The hole can then be filled with concrete and receive rod 24 and plate and nut arrangement 28 as previously discussed.

Figure 25:
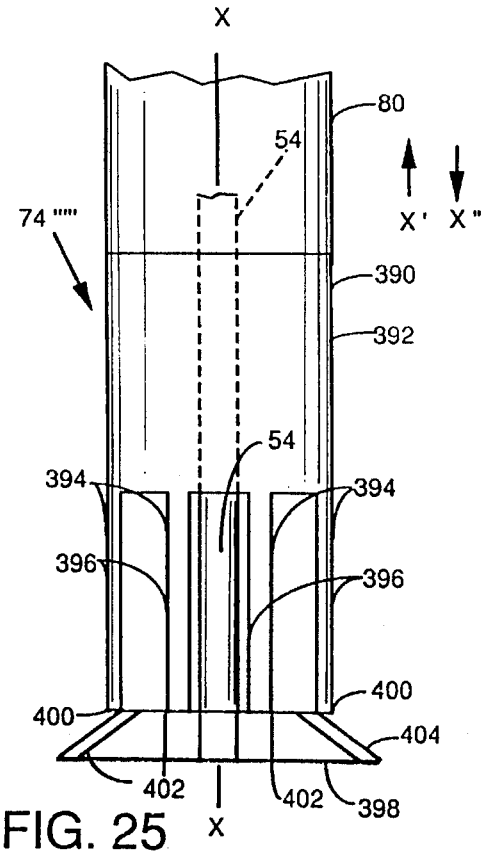
FIG. 25 is a side view of a cutter assembly made in accordance with the present invention in an undeformed state for use with the device shown in FIG. 3.
Figure 26:
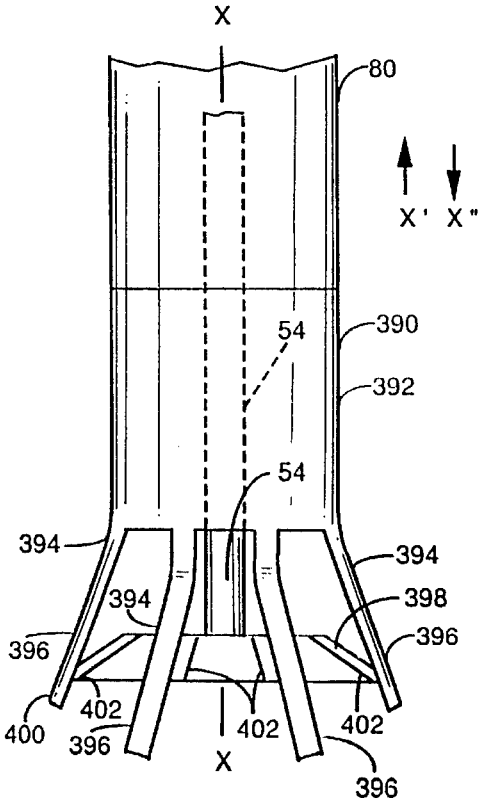
FIG. 26 is a side view of the cutter assembly of FIG. 25 in a deformed state.

FIGS. 25 and 26 show yet another embodiment of a cutting assembly 74"" for use with device 50. Specifically, pivot plate assembly 56 is replaced by a unitary cutter assembly 390. Cutter assembly 390 includes a hollow cylindrical cap or non-cutting section 392, which is adapted to abut against and couple to a bottom section of shroud 80. A plurality of cutters 394 forming a cutting section extend from cutter cylindrical cap 392. Each leg 394 includes a cutting edge 396. Legs 394 are axially spaced apart from each other. A plug 398 abuts against a lower edge 400 of legs 394. Slots 402 are defined in plug 398 that receives lower edges 400 of legs 394.

Operation of the cutting assembly 74"" is similar to the operation of cutting assembly 74. More specifically, once rod 54 begins to rotate about the X axis, which in turn rotates cutter assembly 390 (through plug 398 abutting against legs 394), plug 398 is then forced in the upwardly direction X' toward the bearing plate 102 so as to radially deform the legs 394 as shown in FIG. 26. Edges 396 of legs 394 then cut adjacent medium in hole 52 forming an appropriate recess. The cutter assembly 390 can also be inverted and used to form a foundation type hole. After the hole has been formed, then plug 398, cutter assembly 390 and rod 54 remain in the hole 52 and may form an anchor and/or foundation, and the hole 52 may be filled with concrete.

Figure 27:
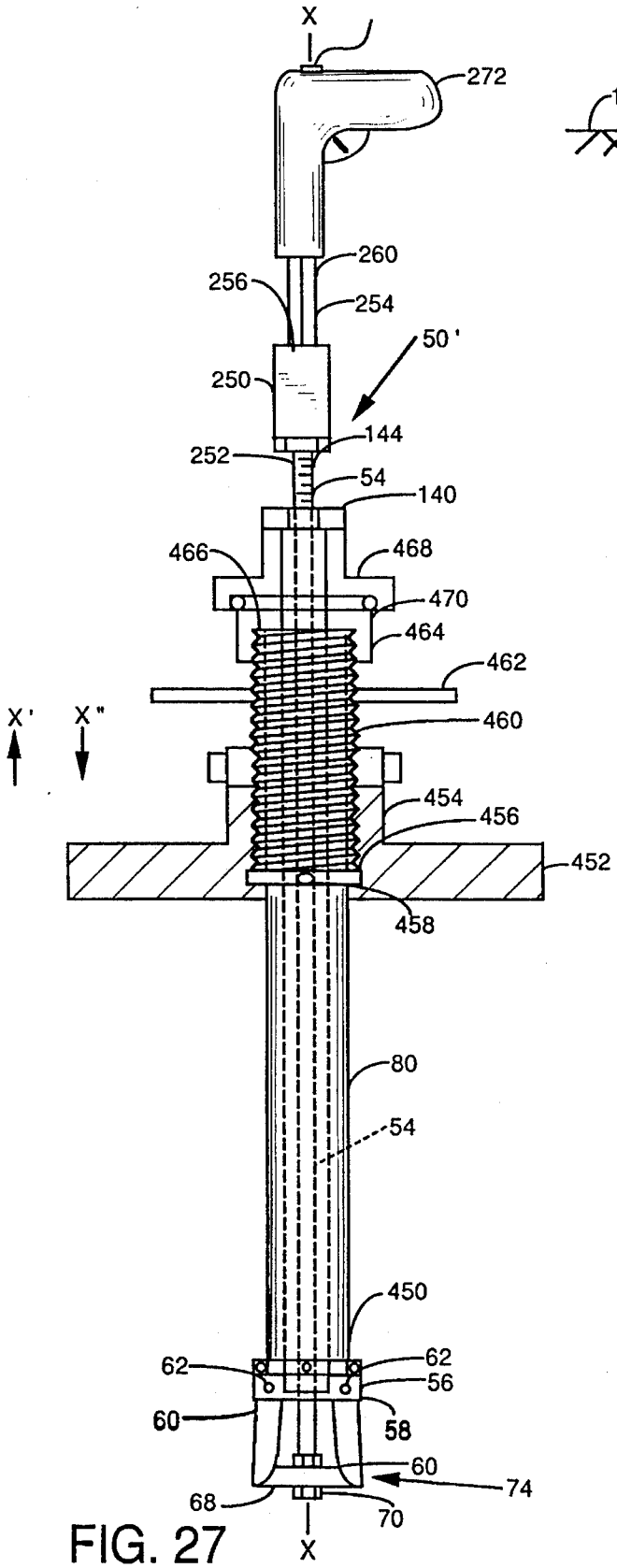
FIG. 27 is a partial sectional side view of another embodiment of a device for augering a conical hole in solid media made in accordance with the present invention.
Figure 28:
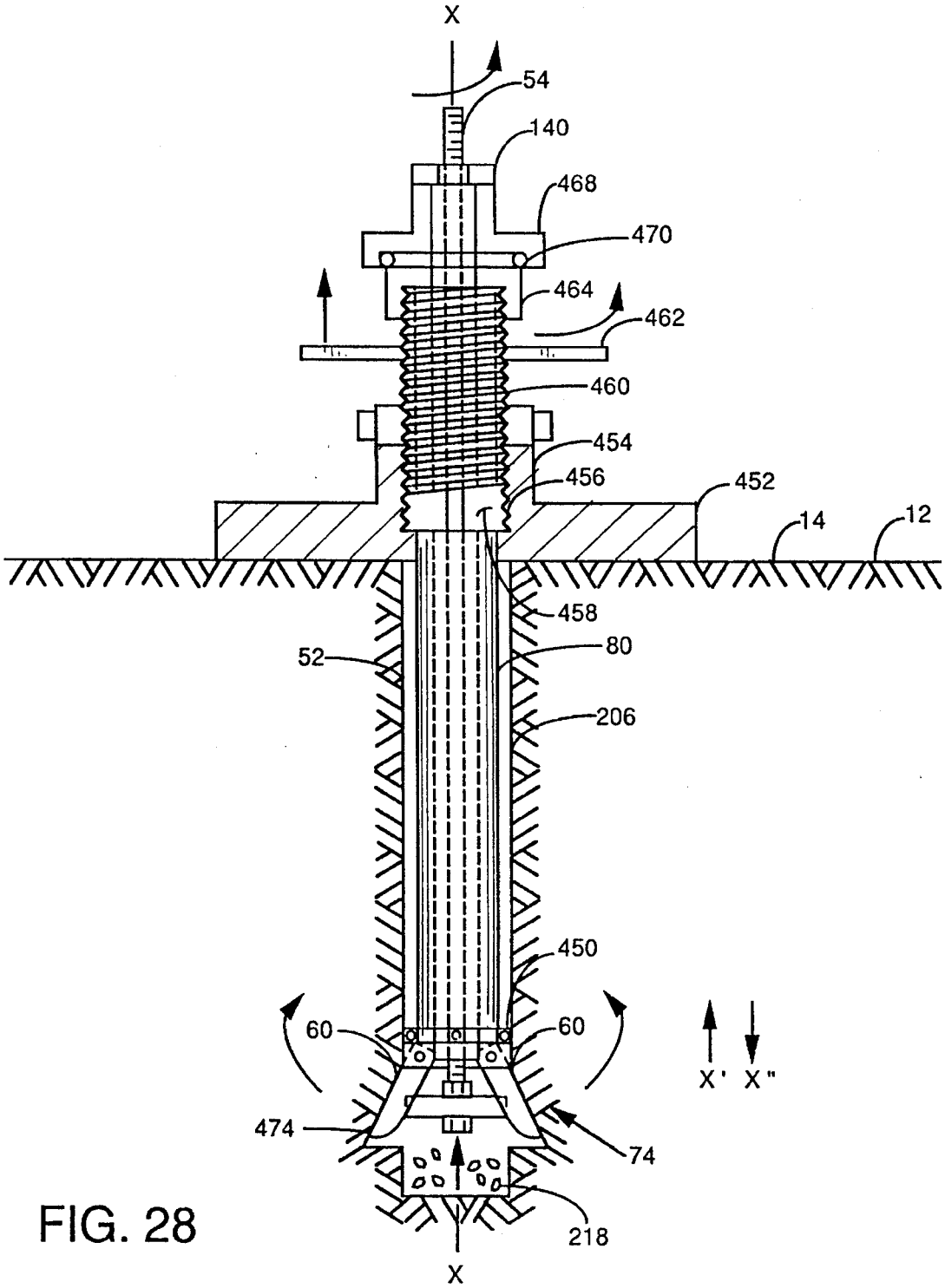
FIG. 28 is a partial sectional side view of a portion of the device of FIG. 27.

FIGS. 27 and 28 show yet another embodiment of the device for augering a conical hole in a solid media 50'. Device 50' is similar to device 50. One difference is that assembly 100 is replaced by a hand operated unit. Like numerals will be used for like elements. Device 50' includes a rod 54 extending in the X axis. End 70 of rod 54 is secured to plug 68, which abuts against blades 60. Blades 60 are pivotally attached to pivot plate 58 via pivot pins 62 and thereby form a pivot plate assembly 56. Hollow cylindrical shroud 80 receives the rod 54. A thrust bearing 450, similar to thrust bearing 90, is sandwiched between the shroud 80 and pivot plate 58.

Shroud 80 is secured to a bearing plate 452, which rests on upper surface 14 of medium 12. An integral collar 454 extends from the plate 452. Collar 454 includes internal threads 456. A hole 458 is defined by bearing plate 452 and collar 454, which is coaxial with shroud 80. A hollow cylindrical threaded member 460 is threadably engaged with collar 454. Handles 462 extend from threaded member 460. A cap 464 is secured to an upper end 466 of threaded member 460. A thrust bearing 468 attaches to an upper end 470 of cap 464. Restrainer nut 140 is secured to rod 54 and rests on thrust bearing 468. An upper end 144 of rod 54 is threadably received by coupling 250, as shown in FIG. 15. End 256 of bar 254 is welded to coupling 250. Rectangular section 260 of bar 254 is received by a drill 472, which replaces motor 212. Rod 54 passes through thrust bearing 468, cap 464, threaded member 460, collar 454, bearing plate 452, thrust bearing 450 and shroud 80, and attaches to plug 68.

In operation, rod 54 is rotated about the X axis by drill 472 thereby causing the blades 60 to rotate about the X axis. Rotation of threaded member 460 about the X axis in a clockwise or first direction causes threaded member 466 to move in the upwardly direction X' relative to bearing plate 452 thereby forcing restrainer nut 140 in the upwardly direction X'. This in turn causes the plug 68 to move in the upwardly direction X' relative to blades 60 which are then pivoted about the pivot pins 62 and forced outwardly in the radial direction thereby forming a frustoconical hole 474 (see FIG. 27). Once hole 474 is formed, then threaded member 460 can be rotated in a counterclockwise or second direction causing blades 60 to retract so that pivot plate assembly 56 can be removed from augered hole 52. Then an anchor can be secured in hole 52. Of course, device 50' can be used to form a hole for a foundation and use any of the cutting assemblies previously discussed.

It is believed that the above described devices 50 and 50' help create improved anchors and foundations over the prior art. Further, the devices 50 and 50' enable an installer to install an anchor and foundation is solid medium quickly and inexpensively. Further, anchors and foundations made in accordance with the present invention can transfer the loading applied thereto directly in the solid medium, i.e., rocks, cement, plastic, plaster or metal, to transfer the loading directly into the medium using the medium's strength to the fullest extent through bearing or compressive loading. It should also be noted that assembly 100 can also be replaced by any arrangement that can move rod 54 in the longitudinal direction X' as rod 54 is rotated about the X axis.

Having described the presently preferred embodiments of my invention, it is to be understood that it may otherwise be embodied within the scope of the appended claims.

I claim:

1. A device for augering a conical hole comprising:

a first elongated member having a first end and a second end extending along a longitudinal axis;

a cutting blade having a cutting section and a non-cutting section, said second end of said first elongated member coupled to said cutting blade, said cutting blade moveable relative to said first elongated member and adapted to be rotated about the longitudinal axis by said first elongated member;

a second elongated member extending along the longitudinal axis having a first end and a second end, said second elongated member second end coupled to said non-cutting section of said cutting blade; and a base coupled to said second elongated member, whereby one of said first elongated member and said second elongated member is adapted to move in a longitudinal direction relative to the other of said first elongated member and said second elongated member thereby causing said cutting blade to move in a radial direction while said cutting blade is rotated by said first elongated member.

2. A device for augering a conical hole as claimed in claim 1 wherein said second elongated member comprises a hollow shaft through which said first elongated member passes.

3. A device for augering a conical hole as claimed in claim 1 wherein said base is secured to said second elongated member.

4. A device for augering a conical hole as claimed in claim 2 wherein said first end of said second elongated member rotatably coupled to said base.

5. A device for augering a conical hole of claim 1 further comprising a plug secured to said second end of said first elongated member, said cutting blade pivotally secured to said second end of said second elongated member wherein said plug coacts with said cutting blade when said first elongated member is moved in the longitudinal direction thereby forcing said blade to pivot in the radial direction.

6. A device for augering a conical hole as claimed in claim 5 wherein said plug includes a surface defining a slot that receives said cutting blade, said surface including a base portion adapted to contact said non-cutting section of said cutting blade.

7. A device for augering a conical hole as claimed in claim 1 further comprising a coupler slideably receiving said first end of said first elongated member, whereby said first elongated member is adapted to move in the longitudinal direction relative to said coupler.

8. A device for augering a conical hole as claimed in claim 7 wherein said coupler coacts with said first elongated member to rotate said first elongated member about the longitudinal axis when said coupler is rotated about the longitudinal axis.

9. A device for augering a conical hole as claimed in claim 7 further comprising a motor coupled to said coupler for rotating said coupler about the longitudinal axis.

10. A device for augering a conical hole as claimed in claim 7 further comprising means to move said first elongated member in the longitudinal direction.

11. A device for augering a conical hole as claimed in claim 8 wherein said coupler comprises a sleeve having an open end and an inner surface defining a cavity for receiving said first end of said first elongated member.

12. A device for augering a conical hole as claimed in claim 11 wherein said inner surface of said coupler defines a rectangular shaped cavity.

13. A device for augering a conical hole as claimed in claim 1 further comprising a motor coupled to said first end of said first elongated member for rotating said elongated member about the first longitudinal axis.

14. A device for augering a conical hole as claimed in claim 1 further comprising means for moving said first elongated member in the longitudinal direction.

15. A device for augering a conical hole as claimed in claim 14 wherein said means for moving said first elongated member in the longitudinal direction comprises, a hydraulic cylinder unit comprising a piston arm moveable within a cylinder, said piston arm extending out of said cylinder and adapted to extend and retract into said cylinder, a first bearing plate secured to said cylinder, a second bearing plate secured to said piston arm, a nipple secured to said cylinder for charging hydraulic fluid thereto, entry of said fluid causing said piston arm to extend outwardly from said cylinder, said bearing plates being parallel to each other, a first bearing plate hole defined in said first bearing plate and a second bearing plate hole defined in said second bearing plate, said first and said second holes aligned with each other for the passage of said first elongated member therethrough, said hydraulic cylinder unit adapted so that a change in hydraulic fluid pressure in said cylinders changes the distance between said bearing plates; and said device for augering a conical hole further comprising a restraining member secured to said first elongated member; a first thrust bearing coupled to said restraining member and said first bearing plate; and a second thrust bearing coupled to said second elongated member and said second bearing plate whereby rotating said first elongated member about the longitudinal axis will not rotate said means for moving said first elongated member in the longitudinal direction.

16. A device for augering a conical hole as claimed in claim 14, wherein said means to move said first elongated member comprises a bearing plate having an opening disposed therein, wherein said first elongated member passes through said opening and said second elongated member is secured to said bearing plate;

a hollow collar attached to said bearing plate, said collar having threads, said first elongated member passes through said collar;

a threaded member threadably engaged with said collar;

a restraining member attached to said first elongated member;

a first thrust bearing coupled to said restraining member and said threaded member; and a second thrust bearing coupled to said bearing plate and said second elongated member, whereby rotating said first elongated member about the longitudinal axis will not rotate said bearing plate, said collar and said threaded member, and rotation of said threaded member about the longitudinal axis forces said first elongated member to move in the longitudinal direction by said restraining member.

17. A device for augering a conical hole as claimed in claim 1 further comprising a second cutting blade, said second cutting blade coupled to said first and said second elongated members whereby when one of said first and second elongated members is moved in the longitudinal direction relative to the other of said first and second elongated members, said second cutting blade moves in a radial direction.

18. A device for augering a conical hole as claimed in claim 17 wherein said first cutting blade and said second cutting blade are positioned on opposite sides of a plane wherein the longitudinal axis is normal to said plane.

19. A device for augering a conical hole as claimed in claim 18 wherein moving said first elongated member in the longitudinal direction causes said first cutting blade and said second cutting blade to move toward the plane.

20. A device for augering a conical hole as claimed in claim 18 wherein moving said first elongated member in the longitudinal direction causes said first cutting blade and said second cutting blade to move away from the plane.

21. A device for augering a conical hole comprising:

a first elongated member having a first end and a second end extending along a longitudinal axis;

a deformable cutting assembly having a cutting section and an integral cap, said second end of said first elongated member coupled to said cutting section;

a second elongated member extending along the longitudinal axis having a first end and a second end, said second elongated member second end coupled to said cap;

whereby one of said first elongated member and said second elongated member is adapted to move in the longitudinal direction relative to the other of said first elongated member and said second elongated member thereby causing said cutting section to deform in a radial direction while said cutting assembly is rotated by one of said elongated members.

22. A method for forming a conical hole comprising the steps of:

a) forming a cylindrical hole defined by a cylindrical hole wall in a solid medium;

b) placing a device for augering a conical hole in the cylindrical hole, said device comprising:

a first elongated member having a first end and a second end extending along a longitudinal axis;

a deformable cutting assembly having a cutting section and an integral cap, said second end of said first elongated member coupled to said cutting section;

a second elongated member extending along the longitudinal axis having a first end and a second end, said second elongated member second end coupled to said cap;

c) rotating said first elongated member about the longitudinal axis, thereby causing said cutting assembly to rotate about the longitudinal axis;

d) moving said first elongated member in the longitudinal direction;

e) deforming said cutting section in a radial direction; and f) forming a conical hole in the solid medium with said cutting section.

23. A device for augering a conical hole comprising:

a first elongated member having a first end and a second end extending along a longitudinal axis;

a cutting blade having a cutting section and a non-cutting section, said second end of said first elongated member coupled to said cutting blade, said cutting blade moveable relative to said first elongated member and adapted to be rotated about the longitudinal axis by said first elongated member; and a second elongated member extending along the longitudinal axis, said second elongated member being a hollow shaft having a first end and a second end, said second elongated member second end coupled to said non-cutting section of said cutting blade, wherein said first elongated member passes through said hollow shaft, whereby one of said first elongated member and said second elongated member is adapted to move in a longitudinal direction relative to the other of said first elongated member and said second elongated member thereby causing said cutting blade to move in a radial direction while said cutting blade is rotated by said first elongated member.

24. A device for augering a conical hole comprising:

a first elongated member having a first end and a second end extending along a longitudinal axis;

a cutting blade having a cutting section and a non-cutting section, said second end of said first elongated member coupled to said cutting blade, said cutting blade moveable relative to said first elongated member and adapted to be rotated about the longitudinal axis by said first elongated member;

a second elongated member extending along the longitudinal axis having a first end and a second end, said second elongated member second end coupled to said non-cutting section of said cutting blade; and a plug secured to said second end of said first elongated member, said cutting blade pivotally secured to said second end of said second elongated member wherein said plug coacts with said cutting blade when said first elongated member is moved in the longitudinal direction thereby forcing said blade to pivot in the radial direction.

25. A device for augering a conical hole comprising:

a first elongated member having a first end and a second end extending along a longitudinal axis;

a cutting blade having a cutting section and a non-cutting section, said second end of said first elongated member coupled to said cutting blade, said cutting blade moveable relative to said first elongated member and adapted to be rotated about the longitudinal axis by said first elongated member;

a second elongated member extending along the longitudinal axis having a first end and a second end, said second elongated member second end coupled to said non-cutting section of said cutting blade; and a coupler slideably receiving said first end of said first elongated member, whereby said first elongated member is adapted to move in a longitudinal direction relative to said second elongated member and said coupler thereby causing said cutting blade to move in a radial direction while said cutting blade is rotated by said first elongated member.

26. A device for augering a conical hole comprising:

a first elongated member having a first end and a second end extending along a longitudinal axis;

a cutting blade having a cutting section and a non-cutting section, said second end of said first elongated member coupled to said cutting blade, said cutting blade moveable relative to said first elongated member and adapted to be rotated about the longitudinal axis by said first elongated member;

a second elongated member extending along the longitudinal axis having a first end and a second end, said second elongated member second end coupled to said non-cutting section of said cutting blade; and means for moving said first elongated member in the longitudinal direction comprising a bearing plate with an opening disposed therein, wherein said first elongated member passes through said opening and said second elongated member is secured to said bearing plate, a hollow collar attached to said bearing plate, said collar having threads, said first elongated member passes through said collar, a threaded member threadably engaged with said collar, a restraining member attached to said first elongated member, a first thrust bearing coupled to said restraining member and said threaded member, and a second thrust bearing coupled to said bearing plate and said second elongated member, whereby rotating said first elongated member about the longitudinal axis will not rotate said bearing plate, said collar and said threaded member, and rotation of said threaded member about the longitudinal axis forces said first elongated member to move in the longitudinal direction by said restraining member, thereby causing said cutting blade to move in a radial direction while said cutting blade is rotated by said first elongated member.

27. A device for augering a conical hole comprising:

a first elongated member having a first end and a second end extending along a longitudinal axis;

a first cutting blade having a cutting section and a non-cutting section, said second end of said first elongated member coupled to said cutting blade, said cutting blade moveable relative to said first elongated member and adapted to be rotated about the longitudinal axis by said first elongated member;

a second elongated member extending along the longitudinal axis having a first end and a second end, said second elongated member second end coupled to said non-cutting section of said cutting blade; and a second cutting blade, wherein said first cutting blade and said second cutting blade are positioned on opposite sides of a plane wherein the longitudinal axis is normal to the plane, said second cutting blade coupled to said first and said second elongated members whereby when one of said first and second elongated members is moved in the longitudinal direction relative to the other of said first and second elongated members, said first and said second cutting blades move in a radial direction and toward the plane while said cutting blades are rotated by said first elongated member.

* * * * *